US006205945B1

(12) United States Patent
Passen et al.

(10) Patent No.: US 6,205,945 B1
(45) Date of Patent: Mar. 27, 2001

(54) FLOATING DOCK INCLUDING BUOYANT WHARF MODULES AND METHOD OF MAKING SUCH MODULES

(75) Inventors: Selvin Passen, Zephye Cove, NV (US); Mark Levin, Baltimore, MD (US)

(73) Assignee: Eastern Floatation Systems, Inc., Baltimore, MD (US)

( * ) Notice: Subject to any disclaimer, the term of this patent is extended or adjusted under 35 U.S.C. 154(b) by 0 days.

(21) Appl. No.: 09/426,643

(22) Filed: Oct. 25, 1999

(51) Int. Cl.[7] ..... B63B 35/44
(52) U.S. Cl. ..... 114/267; 114/357; 405/219
(58) Field of Search ..... 114/266, 267, 114/357, 263; 405/218, 219

(56) References Cited

U.S. PATENT DOCUMENTS

| | | | |
|---|---|---|---|
| Re. 24,837 | 6/1960 | Usab | 114/267 |
| 2,857,872 | 10/1958 | Usab | 114/267 |
| 3,091,203 | 5/1963 | Usab | 114/267 |
| 3,128,737 | 4/1964 | Usab | 114/267 |
| 4,318,362 | 3/1982 | Jung | 114/266 |
| 4,559,891 | 12/1985 | Shorter, Jr. | 114/267 |
| 4,683,833 | 8/1987 | Meriwether | 114/267 |
| 4,709,647 | 12/1987 | Rytand | 114/267 |
| 4,715,307 | 12/1987 | Thompson | 114/267 |
| 4,799,445 | 1/1989 | Meriwether | 114/267 |
| 4,887,654 | 12/1989 | Rytand | 114/267 |
| 4,940,021 | 7/1990 | Rytand | 114/267 |
| 4,947,780 | 8/1990 | Finn | 114/267 |
| 4,974,538 | 12/1990 | Meriwether | 114/267 |
| 5,044,296 | 9/1991 | Finn | 114/267 |
| 5,081,946 | 1/1992 | Nannig et al. | 114/267 |
| 5,199,371 | 4/1993 | Meriwether | 114/267 |

*Primary Examiner*—Jesus D. Sotelo
(74) *Attorney, Agent, or Firm*—Lowe Hauptman Gilman & Berner, LLP

(57) ABSTRACT

Buoyant wharf modules of a floating dock include a rotary molded polyethylene structure having a lower shell portion filled with a steamed polystyrene foam and an upper portion that is a permanent mold form for a concrete aggregate-water mixture. The foam has sufficient compressive strength so that when the mixture is poured into the form over a reinforcing mesh, the form remains stable. The form includes troughs and mesas shaped so that the water flows by gravity to sumps adjacent walls of the form. The walls have openings so the water can flow from modules. Lined tunnels in the set concrete include removable rods having threaded ends which extend through openings in wales extending along longitudinal walls of the modules. Nuts and washers threaded on the rods abut exterior side walls of the wales to hold the modules together. Short spacer tubes having straight side walls abut wales of side-by-side modules. Rods of the side-by-side modules extending through openings of the tubes and walls connect the side-by-side modules to each other by a thread, nut and washer arrangement. Utility lines extending through the tubes extend to a utility tower on an outboard edge of one of the modules via a transverse opening in that module and a depression on that module under the tower. Notches in a bottom face of the modules enable forklift trucks to move the modules on land.

78 Claims, 10 Drawing Sheets

FLOATING DOCK INCLUDING BUOYANT WHARF MODULES AND METHOD OF MAKING SUCH MODULES

TECHNICAL FIELD

The present invention relates generally to buoyant wharf structures and assemblages thereof forming floating docks, and more particularly, to such buoyant wharf structures including a first, upper portion fixedly and permanently secured to a lower portion having a volume and density causing the structure to be buoyant and at least one of the following features:

(1) a permanent mold form in the upper portion for a molded mass having a density greater than water;

(2) a molded mass having a density greater than water, as well as exterior walls and a water impervious floor in the first portion and a drain arrangement so water incident on the molded mass drains out of the buoyant wharf structure;

(3) a deck, on the first portion, that is fixedly and permanently secured to the second portion, wherein exterior walls of the first portion and a shell forming the entire exterior of the second portion are made of a molded organic compound including a shell having a foam mass therein;

(4) a bottom surface with indentations positioned and arranged to receive forks of an industrial forklift truck;

(5) a transverse opening for receiving a utility line and an indentation in the upper portion for receiving the utility line and a utility tower mounted on the deck above the indentation; and (6) an assemblage including first and second adjacent ones of the buoyant structures that are held together by rods extending through tunnels in a molded mass in the upper portion, wherein the rode are fastened to spacers (a) between facing inboard surfaces of the first and second structures and (b) to outboard surfaces of the first and second structures.

A further aspect of the invention relates to a method of making modules having at least one of the aforementioned features.

BACKGROUND ART

There are numerous patents disclosing floating docks made of modular buoyant wharf structures, frequently referred to in the art as floats and pontoons. Some of these prior art structures have been commercialized. The prior art structures, however, have had certain problems, for example, relating to cost, instability in response wave action of the body of water in which the structures are located, and relatively short useful lifetimes.

Usab, U.S. Pat. No. 3,091,203, discloses a concrete floating wharf structure including multiple modules formed as concrete shells tied together by elongated rods extending through tunnels in upper portions of the shells. The manufacture of the concrete shells is expensive, involving three different concrete pouring operations, one for the floor of the shell, a second for the shell walls, and a third for the shell roof. The concrete is poured into a mold around reinforcing mesh. A Styrofoam box goes inside the mold and includes a floor for supporting the concrete of the shell roof. Walls of the shell are formed between the Styrofoam box and the mold, which is removed after the concrete has set. The three step concrete pouring operations are expensive and some skill is required to form the concrete walls of the shell. In addition, the concrete shell is relatively brittle and the exterior surfaces thereof have a tendency to break in transportation, handling and use. In addition, special concrete must be used to prevent electrolysis action between the concrete and salt water where the modules may be located. The electrolysis action has a tendency to eat away the concrete.

Usab is the patentee of other patents having disclosures of structures similar to those found in his '203 patent. These other patents are Reissue 24,837, a reissue of U.S. Pat. No. 2,857,872, and 3,128,737.

Each of Thompson, U.S. Pat. No. 4,715,307, Shorter, Jr., U.S. Pat. No. 4,559,891, Jung, U.S. Pat. No. 4,318,362, and Finn, U.S. Pat. No. 4,947,780, discloses a buoyant modular wharf structure, a multiplicity of which are secured to each other to form floating docks. Each module includes a concrete upper portion and a buoyant lower portion made of a material other than concrete. Each of Thompson, Shorter, Jr., and Jung specifically state that the low density material in the lower portion of each module is Styrofoam. In general, the Styrofoam is packed into a shell made of an organic compound.

The structures of these patents are expensive because of the requirement, in each, for a form that must be disassembled after the concrete has been poured and set. In addition, none of these structures deal with the problem of water that has a tendency to collect in the concrete, particularly between interfaces of the concrete and other parts of the module. The collected water has a long term adverse effect on the module lifetime, particularly in climates where there is repeated freezing and thawing. Such freezing and thawing causes the concrete to break up, to shorten the module lifetime. In addition, if one module takes on a greater amount of water than its neighboring module, that module has a tendency to ride lower in the water than its neighbors, thereby causing dock instability, particularly due to wave action. The modules can, in extreme cases, take on so much water that the freeboard of the module is lost, causing the deck of the module to be below the water surface.

While Rytand, U.S. Pat. No. 4,940,021, considers the problem of dock modules taking on water, the Rytand structure does not include concrete or other molded material in its upper portion. The Rytand buoyant wharf structure includes a lower portion with a shell surrounding a Styrofoam mass. An upper deck portion of the Rytand module is primarily wood, which has a relatively short lifetime in marine environments and has the further disadvantage of splintering which can damage the feet of barefoot pedestrians. Rytand resolves the problem of water being collected between an interface between the shell and a wale simply by providing the shell with a recess immediately below the wale. The recess has an opening located so water entering the recess flows through the opening. Such a simple solution is not applicable to buoyant wharf structures having concrete upper portions.

Rytand is also the patentee of other U.S. Patents, e.g., U.S. Pat. No. 4,887,654 and 4,709,647. Both of these Rytand patents disclose modular buoyant wharf structures having the same general construction as in the Rytand '021 patent. As such, the structures disclosed in the other Rytand patents suffer from a relatively short life because of the wooden decks thereof. The float structure of Nannig et al., U.S. Pat. No. 5,081,946, also has a wooden upper deck portion, subject to some of the same problems as Rytand devices.

Meriwether has several U.S. Patents, e.g., U.S. Pat. Nos. 4,683,833, 4,799,445, 4,974,538 and 5,199,371, all of which disclose floating docks formed of multiple floating wharf modules, each including a molded shell made of an organic compound and a wooden upper deck portion. The modules of these Meriwether patents suffer from the same problems as the wooden structures mentioned before. The structures which hold the various modules together also have durability problems. In addition, the Meriwether wharf modules have the disadvantage of having hollow shells below a water line. If a boat or other vessel contacts the hollow plastic shell, the shell is likely to break, causing the module to take on water, to substantially lower the freeboard of the entire floating dock assembly.

It is, accordingly, an object of the present invention to provide a new and improved buoyant wharf structure, a floating dock including an assemblage of buoyant wharf structures and a method of making such buoyant wharf structures.

Another object of the invention is to provide a new and improved buoyant wharf structure that is relatively easy and inexpensive to manufacture and has a long life, has long useful life, and is highly resistant to saltwater corrosion because of the way it is made and the materials from which it is made, and to provide a method of making same.

An additional object of the invention is to provide a new and improved buoyant wharf structure, particularly adapted to be used as a module for a floating deck, wherein the module has a deck made of a molded material, such as concrete, and wherein the module floats neutral, i.e., has a horizontal central axis on the wharf structure center of buoyancy.

An added object of the invention is to provide a new and improved buoyant wharf structure having a molded upper portion and a buoyant lower portion surrounded by a shell, wherein breaking of the shell has no material adverse effects on the buoyant characteristics of the structure.

A further object of the invention is to provide a new and improved buoyant wharf structure including a molded upper portion that is permanently enclosed by a mold form, including walls and a water impervious floor, wherein the floor of the mold form is maintained stable while plastic material forming the molded mass is being poured into the mold form, and to provide a method of making same.

Still a further object of the invention is to provide a new and improved buoyant wharf structure particularly adapted to be used as a module in a floating dock wherein the buoyant wharf structure is easily moved on land without damage from one place to another with a conventional industrial forklift truck.

Still an additional object of the invention is to provide a new and improved buoyant wharf structure having a molded upper portion surrounded by a permanent mold form, wherein water incident on the molded upper portion and between the molded upper portion and the permanent mold form is easily removed from the buoyant wharf structure.

Still an additional object of the invention is to provide a new and improved floating dock including multiple wharf modules which are attached to each other by a connector arrangement which assists in providing stability to the assemblage and enables the dock to have many different configurations.

A still additional object of the invention is to provide a new and improved floating dock including multiple wharf modules which are attached to each other by a structure for carrying utility lines.

A further object of the invention is to provide anew and improved buoyant wharf structure particularly adapted to receive utility lines extending to a utility tower mounted on a deck of the structure.

SUMMARY OF INVENTION

In accordance with one aspect of the invention, a buoyant wharf structure comprises a first upper portion fixedly and permanently secured to a second portion that is generally below the first portion, wherein the second portion includes a volume and density causing the structure to be buoyant and the first portion includes a deck and a mold form fixedly and permanently secured to the second portion. The mold form has walls and a floor. The floor is fixedly and permanently secured to the walls. A molded mass having a density greater than water substantially fills the mold form.

Preferably, the second portion includes a foam mass with a density less than water. The foam has sufficient compressive strength and is positioned relative to the mold form to support the mold form and enable the mold form to remain relatively stable as the molded mass is being poured while in a plastic state into the mold form.

In a preferred embodiment, the mold form and the molded mass are arranged so water incident on at least one of the mold form and the molded mass drains out of the structure through a drain arrangement, preferably in walls of the mold form. To these ends, the mold form includes plural spaced troughs occupied by the molded mass. The troughs are arranged and positioned so the incident water migrates to the troughs, thence to the drain arrangement.

A feature of the invention is that a reinforcing mesh surrounded by and providing structural strength to the molded mass includes downwardly depending portions supported by the mold form floor and causing the remainder of the reinforcing mesh to be generally spaced above the mold form floor.

A further aspect of the invention concerns a buoyant wharf structure comprising a first upper portion fixedly and permanently secured to a second portion that is generally below the first portion, wherein the second portion has a volume and density causing the structure to be buoyant. The first portion includes a deck, exterior walls and a floor that is water impervious and below the deck. A molded mass having a density greater than water substantially fills the first portion between the floor and walls. The floor, walls and molded mass are arranged to form a drain arrangement so at least some water incident on the molded mass drains out of the structure.

Preferably, the drain arrangement is arranged so the incident water drains through the first portion, particularly through at least some of the walls.

In a preferred embodiment, the floor includes plural spaced troughs occupied by the molded mass. The troughs are arranged and positioned so at least some of the incident water flows to the troughs, which are part of the drain arrangement. Each of the troughs extends to opposite walls of the first portion so the incident water migrates to the opposite walls. The opposite walls include openings aligned with the troughs and positioned so the water migrating in the troughs to the opposite walls escapes through the openings.

A feature of the invention is that each of the troughs includes a depression forming a sump for the water migrating in the troughs; the depressions are adjacent the opposite walls below the openings.

The floor also preferably includes mesas between adjacent pairs of the troughs. The mesas have roofs and walls extending between the roofs of the mesas and floors of the troughs. The roofs slope downwardly toward the walls so at least some of the water incident on the roofs migrates to the walls. The troughs have floors that preferably slope toward the sumps.

Another aspect of the invention includes a buoyant wharf structure comprising a first upper portion fixedly and permanently secured to a second portion that is generally below the first portion, wherein the second portion has a volume and density causing the structure to be buoyant. The first portion includes a deck, exterior walls and a floor, arranged so the exterior walls surround the deck. The exterior walls of the first portion and a shell forming the exterior of the entire second portion are made of a molded organic compound having a foam mass therein.

The shell of the second portion preferably encloses and is filled substantially with a steamed foam mass. The shell of the second portion includes a sealed opening through which the steamed foam mass is injected into the second portion.

A further aspect of the invention relates to a buoyant wharf structure comprising a first upper portion fixedly and permanently secured to a second portion that is generally below the first portion, wherein the second portion has a volume and density causing the structure to be buoyant. The first portion includes a deck, exterior walls and a floor. The second portion includes a bottom surface arranged to support the structure when the structure is on a flat bearing surface. The bottom surface has a pair of elongated substantially parallel indentations that are spaced from each other and shaped for receiving a pair of forks of an industrial forklift truck. Preferably, the indentations extend to oppositely disposed walls of the second portion so a forklift truck can pick up the structure by approaching both of the oppositely disposed walls of the second portion.

Still another aspect of the invention concerns a buoyant wharf structure comprising a first upper portion fixedly and permanently secured to a second portion that is generally below the first portion, wherein the second portion has a volume and density causing the structure to be buoyant and the first portion includes a deck. The deck is fixedly and permanently secured to the second portion. The first portion has exterior walls and a floor that are molded together and made of the same material. A molded mass having a density greater than water substantially fills the volume in the first portion above the floor and between the exterior walls. The molded mass rests on the floor while the structure is in use as a wharf structure floating in water.

Preferably the molded mass includes a plurality of tunnels extending generally parallel to each other and to a first pair of exterior side walls that are generally parallel to each other. The tunnels also extend between a second pair of exterior walls that are generally parallel to each other and at right angles to the first pair of exterior side walls. A rod extends through each of the tunnels and beyond the second pair of exterior walls. Fasteners fixedly mount the rods with respect to the tunnels and the exterior walls. The fasteners and rods enable several of the buoyant wharf structures to be securely connected to each other by wales that extend longitudinally of the wharf structures and engage the exterior walls of the first portion. The rods and tunnels have sizes and geometries such that portions of the exterior surface of the rods are spaced from certain portions of the walls of the tunnels so the rods can be manually moved longitudinally of the tunnels when the fasteners do not fixedly mount the rods. Manual movement of the rods is facilitated by including a liner in the tunnels. The liners are positioned in the tunnels to prevent contact between the rods and the portions of the molded mass forming wall surfaces of the tunnels. For strength the tunnels are generally aligned with and are above the troughs.

Another aspect of the invention concerns a buoyant wharf structure comprising a first upper deck portion fixedly and permanently secured to a second portion that is generally below the first portion, wherein the second portion has a volume and density causing the structure to be buoyant. The structure includes a transverse opening extending between opposite walls of the structure for receiving a utility line. The upper portion includes an indentation in the deck for receiving the utility line. A utility line extends between the walls through the opening into the indentation and into a utility tower fixedly mounted on the deck above the indentation.

An additional aspect of the invention relates to a floating dock comprising an assemblage of buoyant wharf structures, each of which has an upper portion including a molded mass forming a deck and a lower portion. The upper and lower portions are arranged to cause the deck to be in a freeboard condition while the assemblage is in a body of water. Molded masses of first and second adjacent ones of the buoyant wharf structures respectively have first and second tunnels through which first and second rods respectively extend. At least one spacer is in a gap between facing sides of the first and second buoyant wharf structures. A fastener arrangement holds (a) the first rod in situ in the tunnel of the first buoyant wharf structure and in a first wall portion of the spacer and (b) the second rod in situ in the tunnel of the second buoyant wharf structure and in a second wall portion of the spacer.

In the preferred embodiment, the assemblage includes a multiplicity of pairs of the buoyant wharf structures situated and connected in substantially the same manner as the first and second buoyant wharf structures. The multiplicity of pairs of buoyant wharf structures are substantially longitudinally aligned to form an elongated pier portion of the dock. Utility lines located in the spacers extend lengthwise of the longitudinally aligned buoyant wharf structures.

Wales extending longitudinally of the multiple pairs of buoyant structures include bores through which the rods extend. The fastener arrangement holds the rods to the wales so the wharf structures are tied to each other.

A further aspect of the invention relates to a method of making and using a stable buoyant wharf structure. The structure is made from a tub having a first upper portion fixedly and permanently secured to a second portion that is generally below the first portion. The first portion has exterior walls and a water impervious floor. The method comprises feeding a filler having a density less than water into the shell. A settable plastic mass is then poured into the first portion so the settable plastic mass engages the walls and the floor and the floor rests on the filler without being substantially deformed. The plastic mass is then allowed to set against the floor and walls. The structure is then put in water to function as a wharf structure with the floor and walls in situ.

The filler is preferably steamed foam that is fed into the shell through at least one opening in the shell. Then the at least one opening is sealed so the shell is water tight.

The above and still further objects, features and advantages of the present invention will become apparent upon consideration of the following detailed description of a specific embodiment thereof, especially when taken in conjunction with the accompanying drawings.

BRIER DESCRIPTION OF THE DRAWING

DETAILED DESCRIPTION OF THE DRAWING

Figure 1:
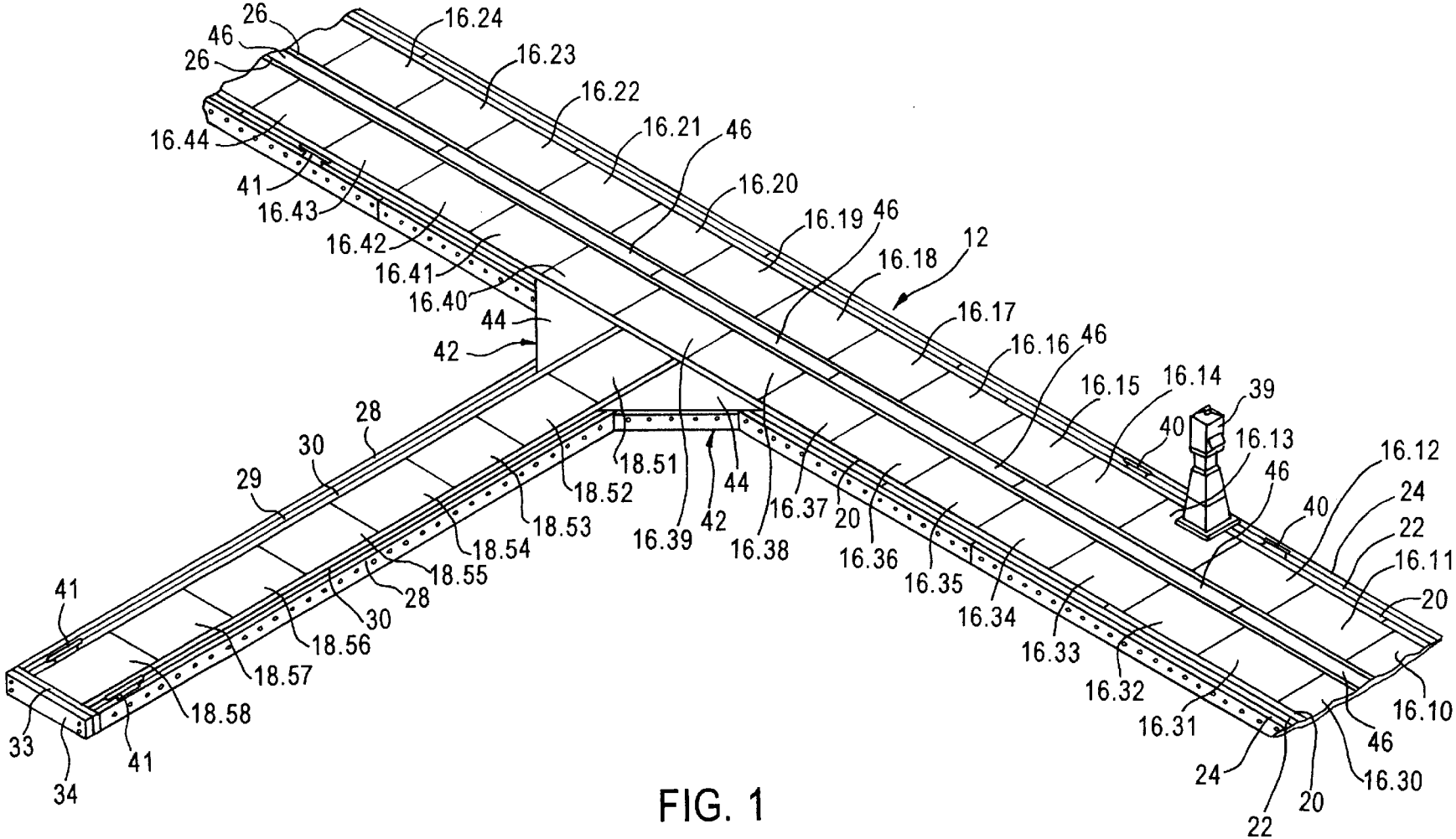
FIG. 1 is a perspective view of a floating dock having a main pier and a finger pier, including buoyant wharf modules in accordance with a preferred embodiment of the present invention.

Referring now to FIG. 1, floating dock 10 includes elongated main pier portion 12 and elongated finger pier portion 14, extending at right angles to each other. Main pier portion 12 includes first and second side-by-side rows of multiple buoyant wharf modules 16.11–16.24 and 16.31–16.44, respectively, while finger portion 14 includes a single row of multiple buoyant wharf modules 18.51–18.58. Each of modules 16 and 18 (hereafter, modules 16.10–16.24 and 16.30–16.44 are generally referred to as modules 16 and modules 18.51–18.58 are generally referred to as modules 18) have a rectangular substantially planar upper deck having a density greater than water. The decks are preferably primarily formed of concrete and typically have the same length and width which, in a preferred embodiment, are respectively five feet and three feet. Each of modules 16 and 18 has a molded lower shell portion substantially filled with a closed cell mass.

Modules 18 are arranged so that aligned longitudinal edges thereof are at right angles to the aligned longitudinal edges of modules 16. The transverse edges of adjacent modules 16 substantially abut each other, as do the transverse edges of adjacent modules 18.

The upper deck portion of each outboard longitudinal edge of modules 16 is enclosed by three side-by-side wooden wales 20, 22 and 24. The upper deck portion of each inboard longitudinal edge of modules 16 is enclosed by one wooden wale 26. Three side-by-side wooden wales 28, 29 and 30 enclose each of the upper longitudinal deck edges of modules 18. Each of wales 20–30 spans the length of several modules 16 and 18. The longitudinal ends of the wales are staggered to provide enhanced stability for the floating dock. The outer edges of the decks of end modules 16.10 and 16.30 of main portion 12 are enclosed by two side-by-side wales 31 and 32 (FIG. 4) while the deck of end module 18.58 of finger pier portion 14 is enclosed by side-by-side wales 33 and 34.

Wales 31–34 protect modules 16 and 18 if an errant boat or other vessel strikes the ends of dock 10. Wales 31 and 32 also enclose the gap tubes 70 occupy. Lag bolts 35 secure wales 31 and 34 to wales 22 and 29. The way wales 20–30 are secured to the longitudinal edges of modules 16 and 18 is described infra in detail.

Relatively short spacer tubes 70 (FIG. 4), having a rectangular cross section and made of steel having a galvanized coating, extend between adjacent inboard edges of modules 16, so the exterior faces of opposite walls of the tubes abut inboard wales 26. Tubes 70 assist in connecting together the adjacent inboard edges of the modules 16 in the first and second rows of main dock portion 12. Tubes 70 also carry utility lines, e.g., water, electric and communications, which extend to utility tower 39 fixedly mounted along the outboard edge of module 16.13. Details of tubes 70 and how the utility lines are connected to tower 39 are described infra.

Elongated plywood planks 46 covering tubes 70 are fixedly secured, e.g., by nails or screws, to the upper portions of wales 26 on the inboard edge of main dock portion 12. Tie cleats 41 fixedly mounted along outboard wales 20–24 and 28 of main portion 12 and finger portion 14 assist in docking boats to pier assembly 10.

Figure 2:
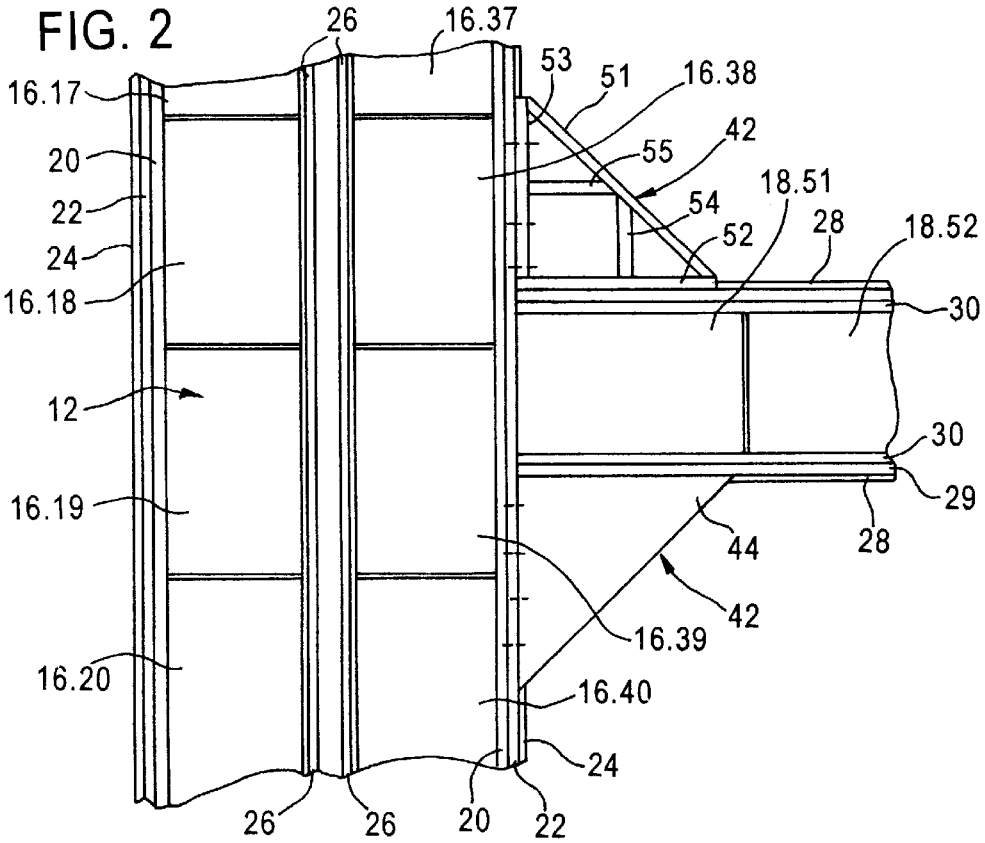
FIG. 2 is a top view of a portion of the dock illustrated in FIG. 1, where the main pier and finger pier intersect.

A pair of triangular trusses 42 (FIGS. 1 and 2) made of galvanized steel fixedly connect main portion 12 and finger portion 14 to each other. Each of trusses 42 is a triangular frame including steel galvanized channels 51–53 respectively forming the hypotenuse and legs of a right isosceles triangle. Channels 52 and 53 are respectively fixedly secured to the exterior walls of wales 24 and 30 on the longitudinally extending sides of main dock portion 12 and finger dock portion 14. Galvanized struts 54 and 55, which respectively extend parallel to channels 52 and 53, provide stability to truss 42. Strut 54 is fixedly connected between a center portion of channel 52 and a center portion of a channel 51, while strut 55 is fixedly connected between central portions of channels 51 and 53. Welded joints (not shown) secure channels 51–53 and struts 54–55 to each other to form trusses 42.

Fasteners (described infra) that hold rods in modules 16.37–16.40 and 18.51 in place between wales 20–30 also secure channels 52 and 53 to wales 24 and 30. Thus, the fasteners and rods hold modules 16.37–16.40 and 18.51 to each other and hold trusses 42 in place at the intersection of the main and finger pier portions of dock 10. Triangle shaped plywood planks 44, securely fastened to the channels by any suitable means, completely cover the upper faces of trusses 42.

Figure 5:
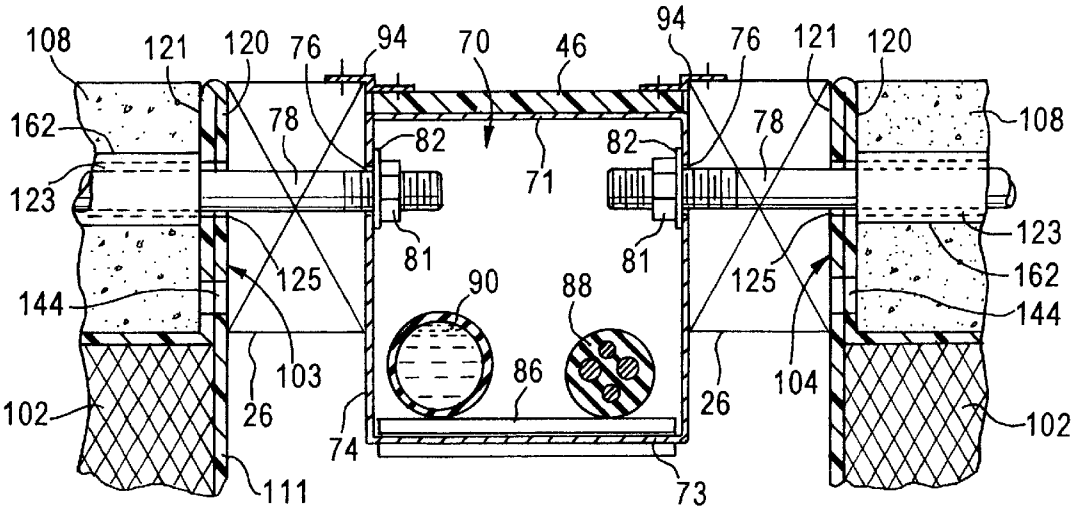
FIG. 5 is a side sectional view taken through the lines 5—5, FIG. 4.
Figure 8:
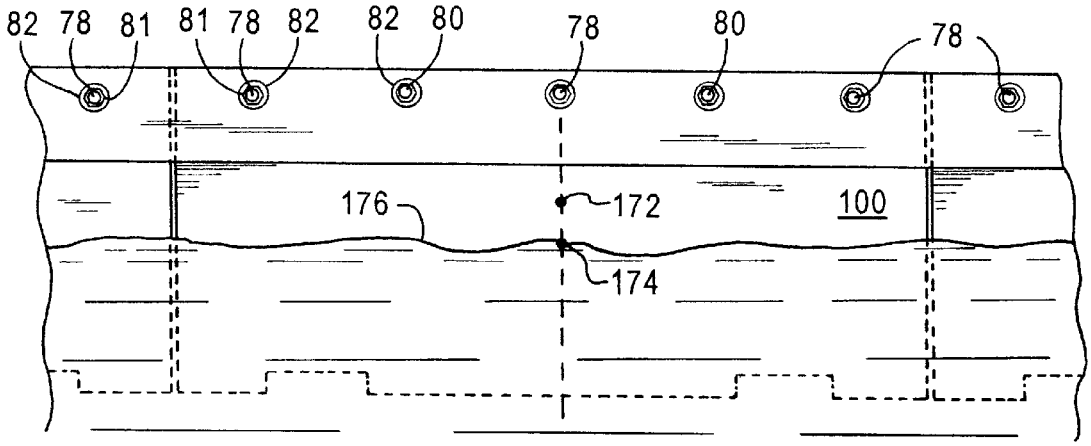
FIG. 8 is a longitudinal view of several completed wharf modules of the type illustrated in FIGS. 6 and 7, as they float in a body of water as part of the dock of FIG. 1.

As illustrated in detail in FIG. 5, each of short galvanized steel tubes 70, has four straight sides 71–74 to form a rectangular cross section. Elongated plywood planks 46, fixedly secured to the upper face of roof 71 of tube 70, complete a walkway on pier portion 12. Tubes 70 are instrumental in securing modules 16.10–16.24 of the first row of dock portion 12 to modules 16.30–16.44 of the second row. Vertically extending walls 72 and 74 of tubes 70 include circular openings 76 that are aligned with each other and are considerably above the horizontal center line of tube 70.

Figure 4:
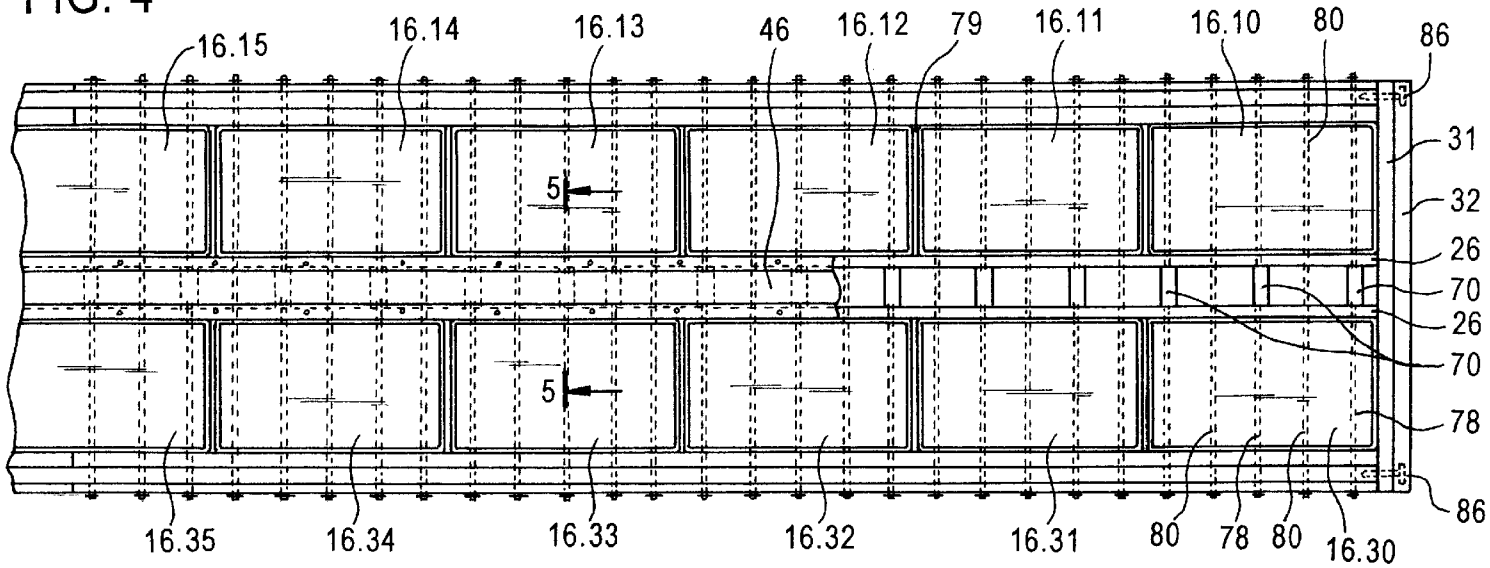
FIG. 4 is a top view of one end of the main pier of the dock of FIG. 1.

Threaded ends of steel galvanized rods 78 that extend transversely through tunnels 123 in the concrete deck of each of modules 16 extend through openings 76 and are fastened to tubes 70 by nuts 81 and washers 82. Nuts 81 are threaded against washers which bear against the inner faces of walls 72 and 74. Rods 78 extend through bores in inboard wales 26 and outboard wales 20–24, as illustrated in FIG. 4.

Nut and washer fasteners on outboard wales 24 hold rods 78 in place on the outboard side of main pier portion 12, in a manner similar to that described in detail in connection with FIG. 5, except that the washers on the outboard sides bear directly against wales 24. Similar rod and fastener arrangements on the outside of modules 18 hold modules 18 to wales 28–30 and each other.

As the wales shrink due to weathering, nuts 81 are tightened further against washers 82 and the wale against which the washer abuts to provide a rigid connection between the wales and the modules. After a sufficient period of use, wales 20–30 will have shrunk sufficiently to preclude the necessity for further nut tightening.

The connections between spacer tubes 70 and rods 78 exert compressive forces on modules 16 and 18 to hold the modules in place relative to wales 20–30 and tubes 70.

Tube 70 carries a pair of spaced plastic slotted sleeves 86 (only one of which is illustrated) that fit over opposite ends of floor 73 of tube 70, between the tube side walls 72 and 73, to function as a pad or cushion for utility lines, e.g., electric cable 88 and water line 90. Utility lines 88 and 90 as they extend through tubes 70 bear against sleeves 86, but hang free in the space between the tubes. Openings 76, being in the upper portion of walls 72 and 74 of tube 70, enable the tube to have sufficient room to receive more than two utility lines. Galvanized metal "Z" clamps 94, which are nailed or screwed to the top faces of wales 26 and plywood plank 46, fixedly mount the plank to the wales and the top face of wall 71 of tube 70.

Figure 3:
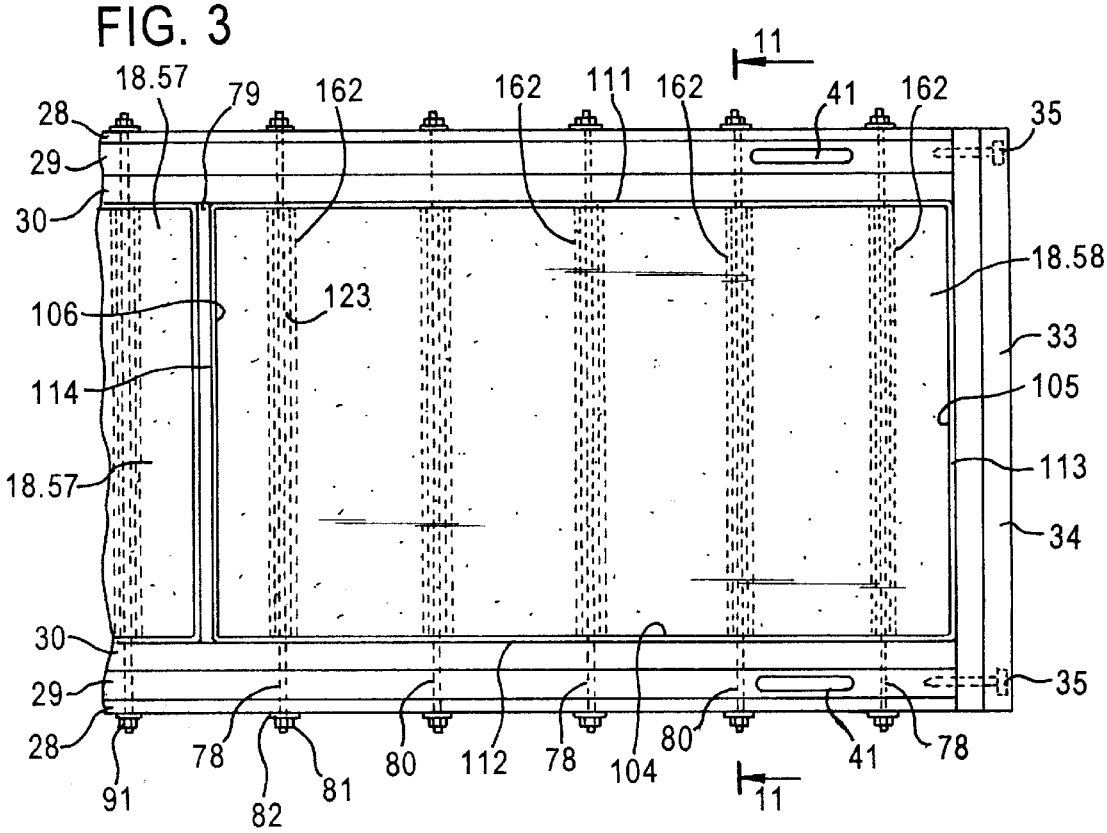
FIG. 3 is a top view of the end of the finger pier of the dock of FIG. 1.

As illustrated, for example, in FIGS. 3 and 4, adjacent longitudinally extending float modules, for example, modules 16.10 and 16.11 and modules 18.57 and 18.58, have the transverse edges thereof spaced by a relatively small gap 79, such as one-quarter to one-half inch. Gap 79 prevents the adjacent modules from contacting each other as a result of wave action of a body of water where dock 10 floats. Consequently, the adjacent modules do not crash into each other and damage to them does not occur as a result of the wave action. The way modules 16 and 18 are connected to each other by rods 78 and 80, wales 20–30 and the fasteners including nuts 81, enables the gap to be maintained.

Each of the buoyant wharf modules 16 includes three transversely extending rods 78, each of which is connected to a separate one of tubes 70, as illustrated in FIG. 5. Each of modules 16 also includes two additional transversely extending rods 80 (FIG. 4) which connect adjacent side-by-side float modules, such as modules 16.10 and 16.30, in the first and second rows of main pier portion 12. Each of rods 80 extends through aligned tunnels 123 in adjacent side-by-side modules in main pier portion 12. Tunnels 123 have an inner diameter substantially larger than the outer diameter of rods 78 and 80 to facilitate manual insertion of the rods in the tunnels and alignment of the tunnels with each other (as appropriate) and with bores in wales 20–30. The aforementioned positions of rods 78 and 80 and tunnels 123 are preferred because of the stability they provide to dock 10 in connecting individual modules 16 and 18 to each other and to wales 20–30.

Each of rods 80 is somewhat more than twice as long as each of rods 78 and spans a gap between adjacent modules of the first and second rows where tubes 70 are positioned. The gap is defined by the lengths of roof 71 and bottom 73 of tubes 70. Rods 78 and 80 alternate with each other so rods 78 are at opposite ends and in the middle of each module 16 and rods 80 are between rods 78. In the preferred embodiment, rods 78 and 80 are equi-spaced from each other, about one foot apart.

In certain instances where docks wider than dock 10 are desired, three or more modules are connected to each other by rods similar to rods 78 and 80. In such an instance, the elongated sides of first and second adjacent side-by-side modules 16 can be spaced from each other by a relatively small gap, such as the one-quarter inch gap which exists between modules 16.10 and 16.11 and the elongated sides of second and third adjacent side-by-side modules are connected to each other by spacer tubes similar to tubes 70. In such a situation, the modules are connected together by rods longer than rods 80.

Each of modules 18 includes five rods 78 having threaded ends that extend through tunnels 123 in the modules and circular bores in wales 28–30 that are aligned with the tunnels. Rods 78 of modules 18 are fastened by nuts 81 and washers 82 to wales 28–30 to connect modules 18 to each other.

Figure 6:
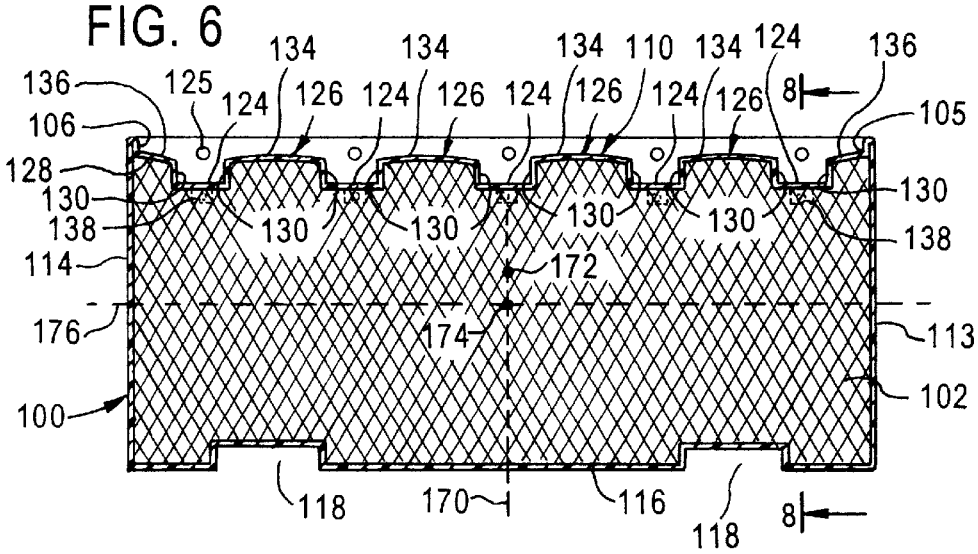
FIG. 6 is a longitudinal sectional view of a buoyant wharf module included in the floating dock of FIG. 1 prior to a concrete deck forming mass being poured into the module.
Figure 9:
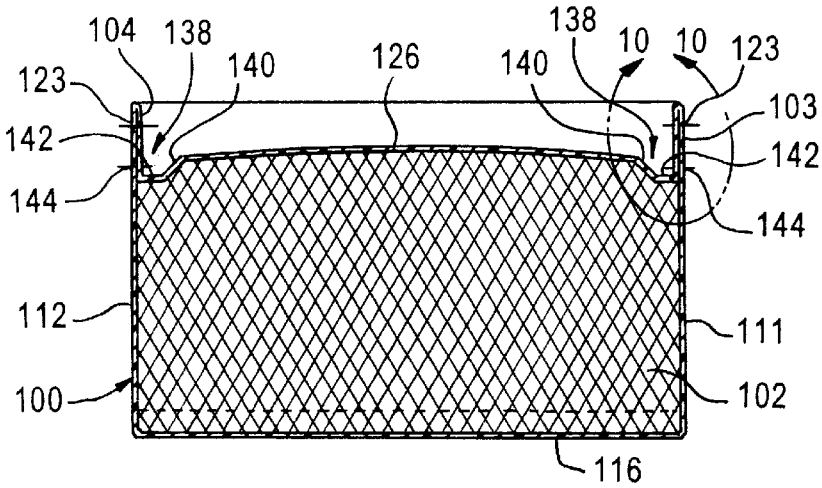
FIG. 9 is a side sectional view of the buoyant wharf module, as taken through the lines 8—8, FIG. 6.
Figure 11:
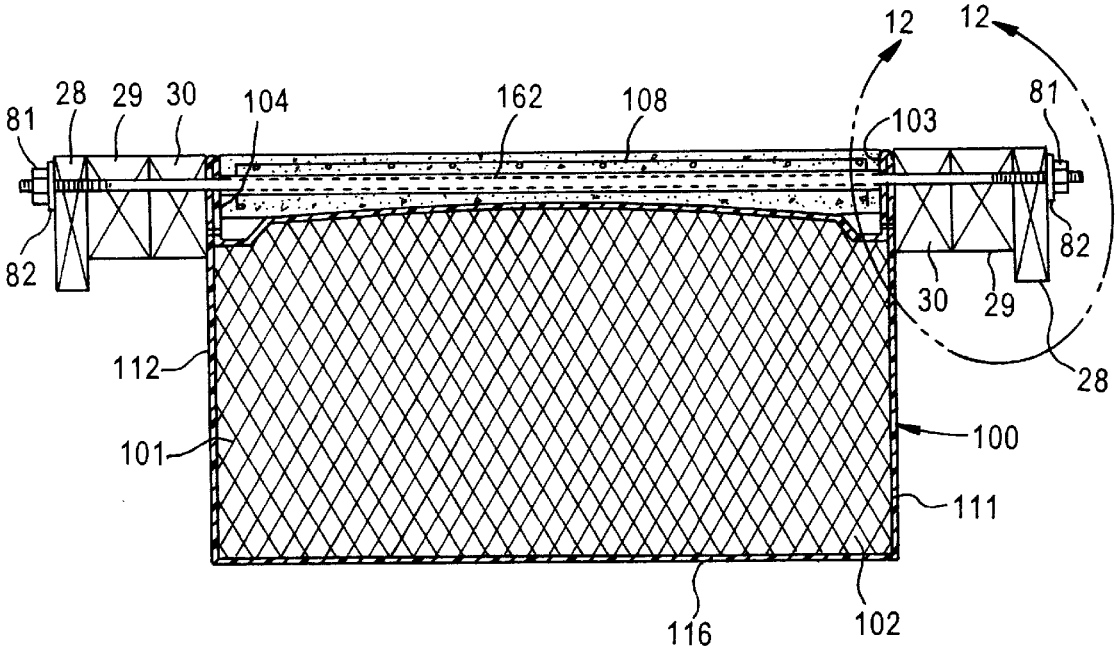
FIG. 11 is a side view of a finished module with a concrete molded deck, in combination with wales and a rod extending through a tunnel in the concrete molded deck of the module.

As illustrated in FIGS. 6, 9 and 11, each of modules 16 and 18 comprises tub 100 including completely enclosed shell 101, essentially filled with a closed cellular, low density (considerably less than water) plastic foam 102. Shell 101 is essentially shaped as a right parallelepiped, having roof 110, straight side walls 111–114 and floor 116, which bears the load of the module when the module is on land.

Figure 12:
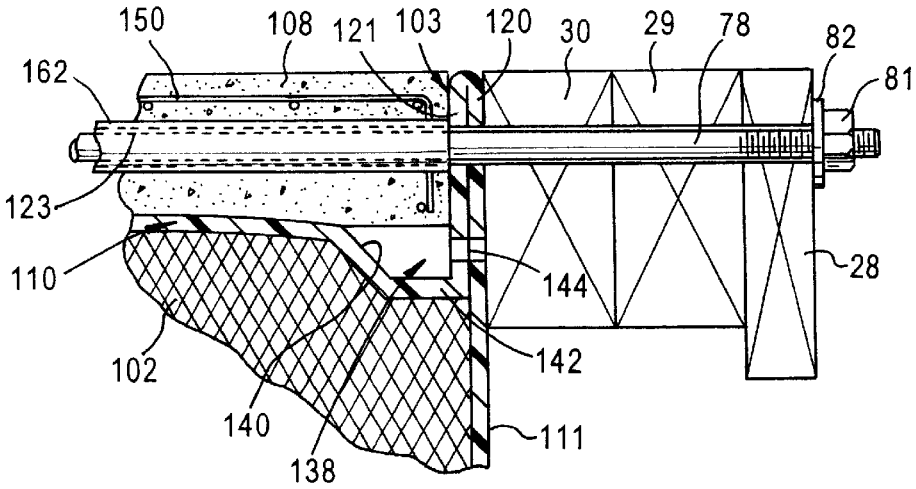
FIG. 12 is an enlarged view of the portion of FIG. 11 indicated by the circle 12—12.

Lips 103–106, respectively aligned with walls 111–114, extend above shell 101. Lips 103–106 are part of a permanent mold form for a relatively high density (considerably greater than water) molded mass 108 that is poured in a plastic state onto the top of roof 110 that forms a floor of the mold form. Each of lips 103–106 includes two abutting segments 120 and 121 (FIG. 12), so segment 121 is bent over on segment 120.

In the preferred embodiment, tub 100 is a rotational molded water impervious organic compound, particularly a 50/50 mixture of high and low density polyethylene, foam 102 is steam filled expanded polystyrene (i.e., Styrofoam), and molded mass 108 is concrete. The use of concrete as moldable mass 108 is advantageous because concrete is relatively immune to weathering. Because foam 102 is a closed cellular structure, a rupture in walls 111–114 of tub 100 or a rupture in the bottom 116 of the tub has no substantial effect on the buoyancy properties of the floating module. Steam filled expanded polystyrene is also advantageous because of the ease with which it can be inserted into shell 100, as described infra; the rotational molding of tub 100 from polyethylene enables shell 101 and the mold form, comprising lips 103–106 and roof 110, to be made as a single, one piece water impervious unit.

Each module 16 and 18 has dimensions and a shape, i.e., geometry, causing each of the individual modules and dock 10 to be very stable in the body of water in which they are located. In addition, as described infra, each of modules 16 and 18 is designed so that water incident on the concrete deck of the module is not collected by the module, but flows out of the module. Consequently, water drains from the module and does not cause cracking of concrete mass 108, particularly during freezing and thawing cycles. It is important to remove water from the interfaces between concrete mass 108 and walls 103–106 and roof 110 because concrete mass 108 and the polyethylene compound preferably used to form tub 100 do not bond to each other. Preventing the accumulation of water is important to prevent loss of freeboard and uneven flotation of the individual modules 16 and 18 and/or dock 10.

To facilitate movement of modules 16 and 18 on land, floor 116 of tub 100 includes traverse indentations forming forklift slots 118 which extend parallel to side walls 113 and 114. Slots 118, which extend completely across each module between walls 113 and 114, are spaced and have heights to receive the forks of a forklift truck of the type generally used for industrial purposes. The forklift trucks can approach the modules from either of walls 113 or 114.

Figure 7:
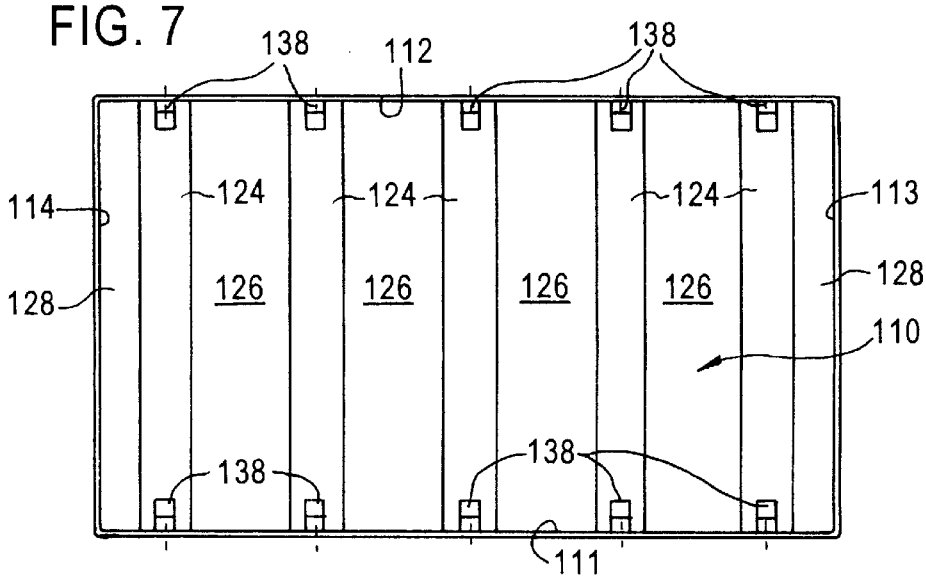
FIG. 7 is a top view of the wharf module illustrated in FIG. 6.

To provide the water drainage feature mentioned above, top 110 includes five troughs 124 (FIGS. 6 and 7), such that adjacent trough pairs are spaced from each other by mesas 126 and the troughs closest to walls 113 and 114 are spaced from walls 113 and 114 by mesas 128. Each of mesas 126 has a span in the direction between walls 113 and 114 that is about twice that of each of mesas 128.

Each of mesas 126 and 128 extends completely between walls 111 and 112. Each of mesas 126 and 128 includes side walls 130 of equal height and a curved roof 134 such that the peak of each mesa roof is about equidistant from the walls of the respective mesa. The peaks of curved roofs 136 of mesas 128 are at the intersections of mesas 128 and walls 113 and 114. The curvatures of roofs 134 and 136 of mesas 126 and 128 cause water incident on these roofs to flow into troughs 124.

Each of troughs 124 extends completely across top 110 between walls 111 and 112, in a direction parallel to walls 113 and 114. Each of troughs 124 is curved, i.e., has a taper, such that the zenith of each trough is about mid-way between walls 111 and 112 and the ends of each trough abutting walls 111 and 112 are at the nadir of the troughs. As a result, water migrating into troughs 124 flows toward end walls 111 and 112 as well as lips 103 and 104.

Figure 10:
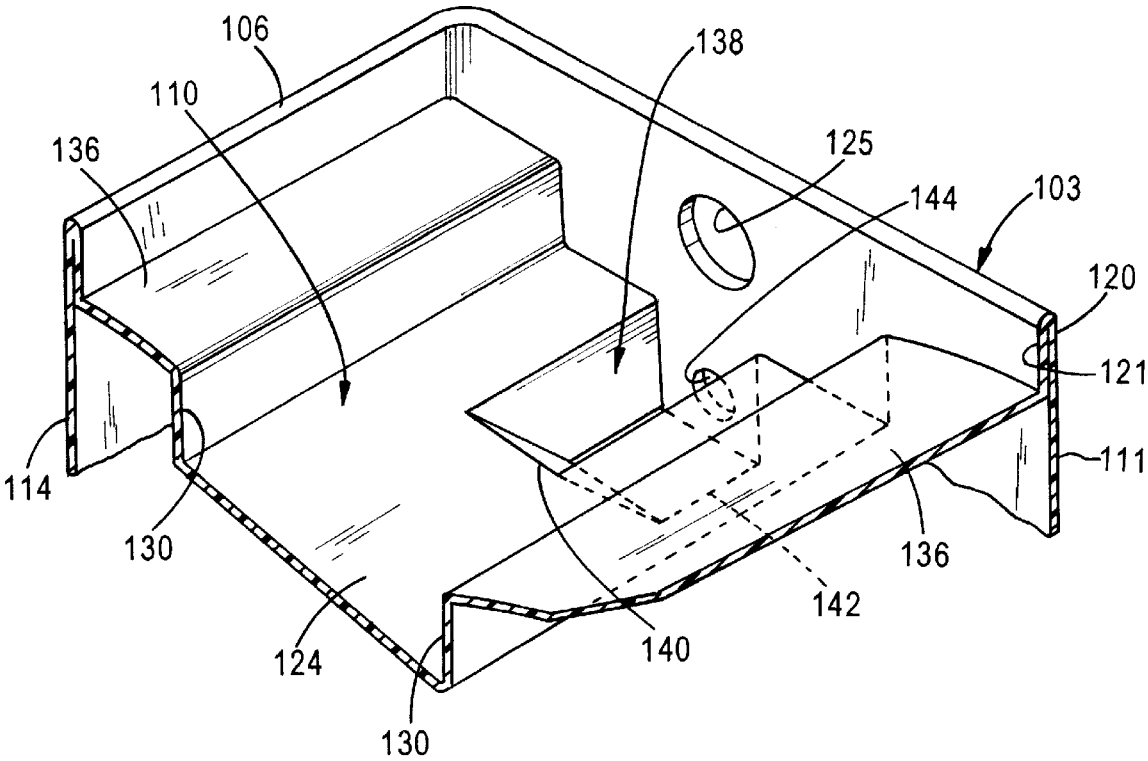
FIG. 10 is an enlarged perspective view of a portion of the buoyant wharf module as indicated by the circle labeled 10—10 in FIG. 9.

To collect the water at walls 111 and 112, the end of each of troughs 124 includes a depression, i.e., drain sump, 138 (FIGS. 7, 9 and 10) which is approximately halfway between the side walls 130 of the mesas between the troughs. Each of drain sumps 138 includes a wall 140 that slopes from the bottom of the respective trough 124 to horizontal floor 142 of the respective sump. Each of drain sumps 138 is associated with a circular opening 144, formed in walls 111 and 112. Each opening 144 is vertically aligned with its associated sump 138 and is located slightly above the sump floor 142 and below the bottom of trough 124. Thereby, water flowing into drain sump 138 escapes from the drain sump through opening 144.

As previously mentioned, concrete mass 108 abuts, but is not bonded to, mold form lips 103–106 and top 110 of the shell enclosing foam 102. Steel mesh 150, carried by top 110, is completely surrounded by concrete mass 108 to stabilize the concrete mass. Mesh 150 includes a grid of steel galvanized rods 152 and 154 having a relatively small diameter, such as one eighth of an inch. Rods 152 and 154 are bonded to each other and include turned ends 156 forming feet that engage the top face of roof 110 by contacting roofs 134 and 136 of mesas 126 and 128. Preferably, the openings in mesh 150 between rods 152 and 154 are approximately two inches by two inches, a dimension which has been found satisfactory to enable the relatively free flow of a mixture of concrete aggregate and water to flow through the mesh, while providing the necessary strength and stability for the concrete deck after the mixture has set.

Figure 13:
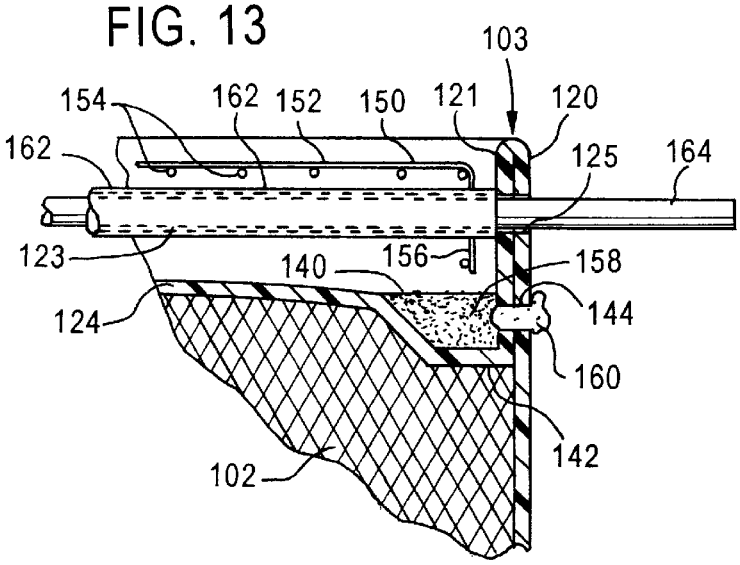
FIG. 13 is a view of the structure illustrated in FIG. 12, without the wales and including a supporting rod different from the rod illustrated in FIG. 11, prior to the concrete being poured into the module.

To enable drain sumps 138 to be formed and prevent the concrete aggregate-water mixture from entering the drain sumps, the sumps are filled with sand mass 158 (FIG. 13) prior to and while the mixture is being poured into the mold form including lips 103–106 and roof 110. Prior to and during the concrete pouring process, opening 144 is filled with fabric stuffing 160 to prevent splashing of sand mass 158. Stuffing 160 and sand mass 158 are removed from opening 144 and sump 138 after concrete mass 108 has set by pulling the stuffing from the opening and sucking the sand through the opening.

Rods 78 and 80, discussed supra, extend through aligned circular openings 125 in lips 103 and 104 above and in approximate alignment with the centers of troughs 124. Rods 78 and 80 extend beyond lips 103 and 104 and through the concrete mass 108 of each of modules 16 and 18. To facilitate assembly of the dock of FIG. 1, however, rods 78 and 80 are not actually immersed in concrete mass 108. Instead, rods 78 and 80 are insertable into and removable from tunnels 123 in concrete mass 108.

Figure 15:
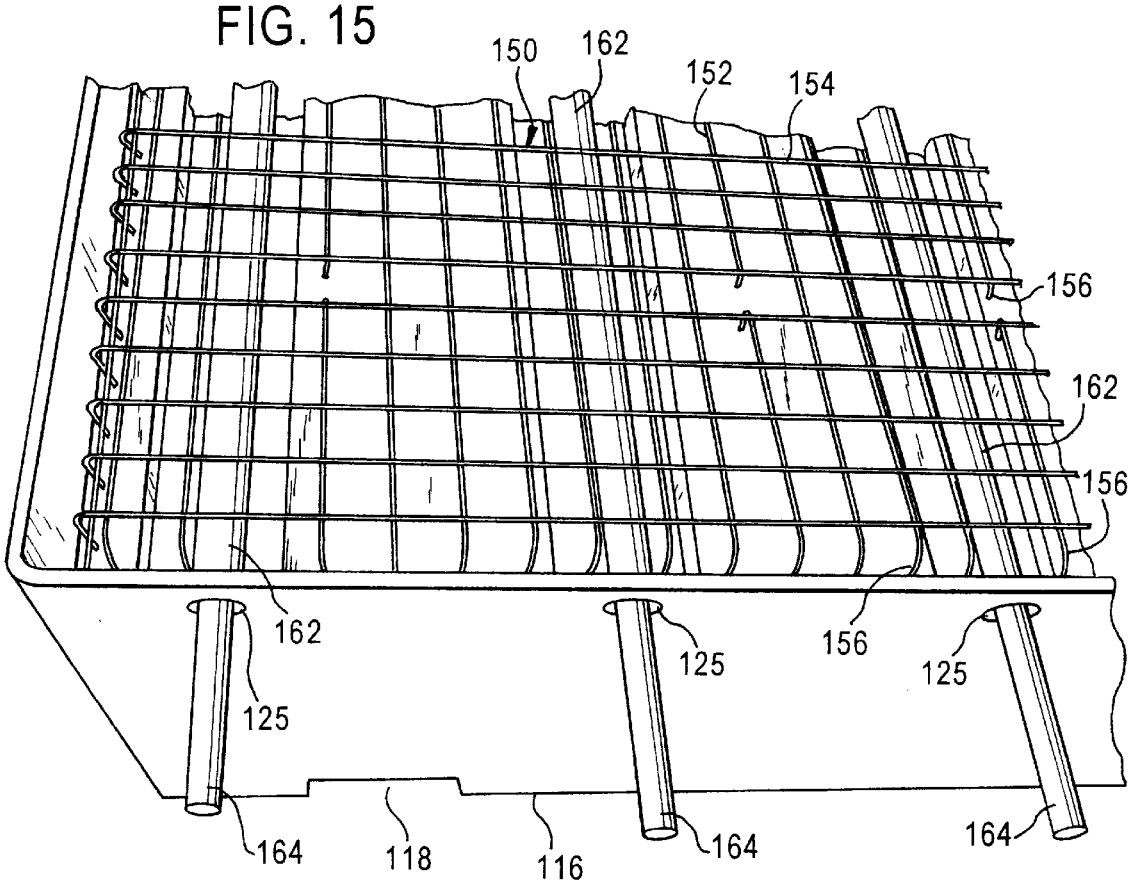
FIG. 15 is a perspective view of a portion of an unfinished module including reinforcing mesh and steel supporting rods inserted into polyvinyl chloride tubes.

To these ends, each of the tunnels 123 for receiving rods 78 and 80 includes a low coefficient of friction polyvinyl chloride liner tube 162 (FIGS. 5, 13 and 15) that extends above each of troughs 124 between lips 103 and 104. To prevent deformation of polyvinyl chloride tubes 162 while the concrete aggregate-water mixture that forms concrete mass 108 is being poured into the form comprising lips 103–106 and roof 110, steel filler rods 164 (FIGS. 10, 11 and 13), are inserted into polyvinyl tubes 162 before the mixture is poured. Rods 164 have an outer diameter that is only slightly less than the inner diameter of tubes 162, so the tubes do not bend or bow as the concrete aggregate-water mixture is being poured into the mold form. To assist in removal of rods 164 after the concrete has set, rods 164 extend appreciably beyond the exterior side walls 111–114 of tub 100. After steel rods 164 have been removed from tubes 162, the appropriate steel galvanized rods 78 and 80 are manually inserted into plastic tubes 162.

Figure 14:
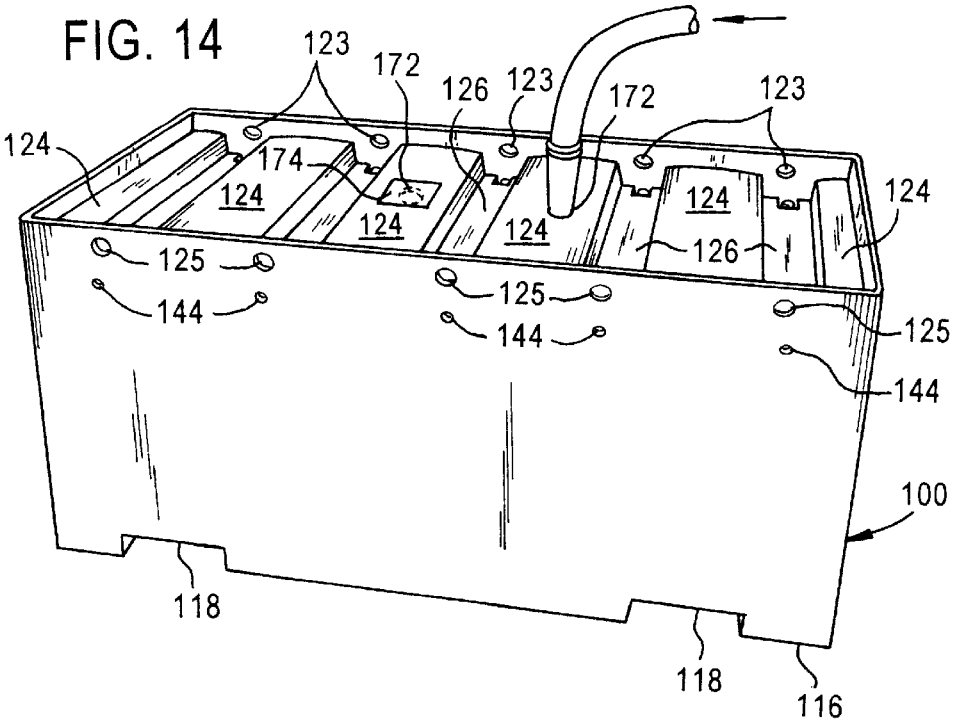
FIG. 14 is a view indicating how steamed polystyrene is inserted into a shell of an unfinished module of the type illustrated in FIG. 6.
Figure 16:
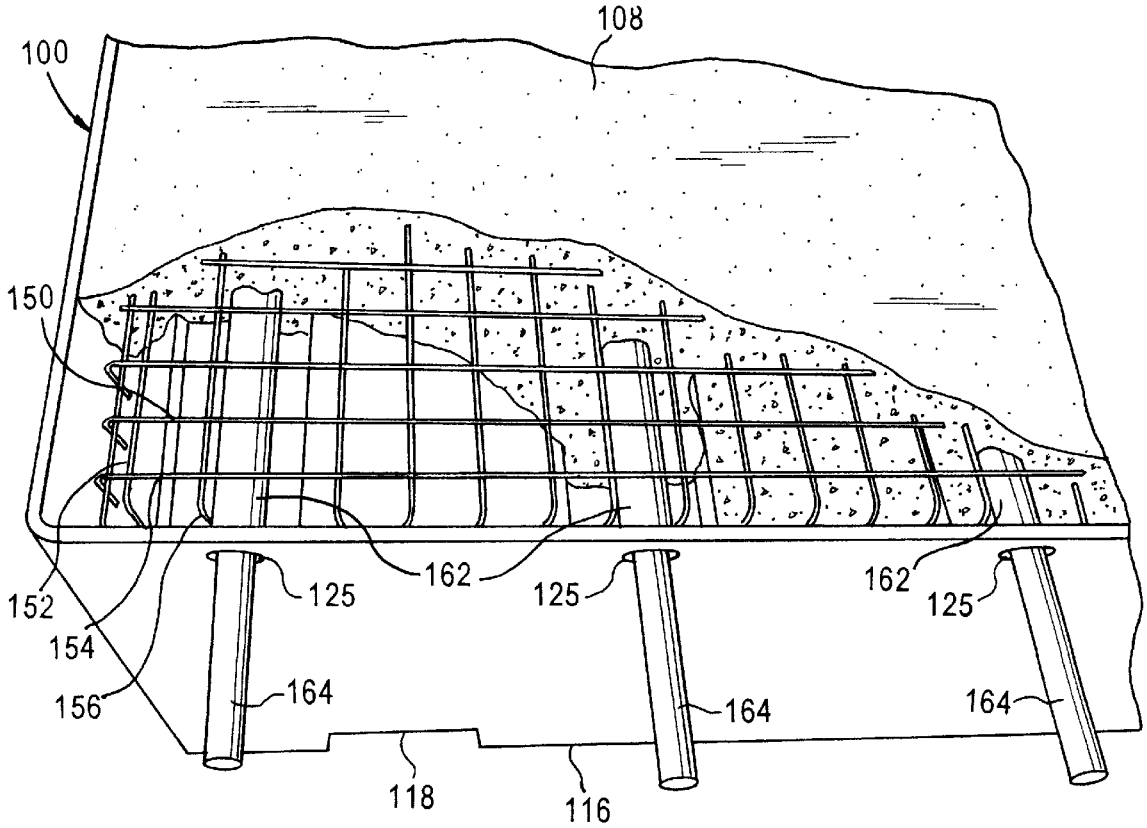
FIG. 16 is a perspective view similar to the perspective view of FIG. 15, with concrete poured into the top portion of the module.

In the preferred embodiment, the closed cell expanded polystyrene flows through nozzle 170 and openings 172 with steam from a suitable source (not shown), as illustrated in FIG. 14. Openings 172 are in roofs 136 of center mesas 124. After the foam, which typically has a density of approximately one pound per cubic foot, has filled shell 101, nozzle 170 is removed and openings 172 are closed by plastic patches 174 using a conventional plastic sealing process.

While the use of steam foam is preferred, because of its relatively low expense, it is to be understood that shell 101, as formed by side walls 111–114, roof 110 and bottom 116, can be filled with solid foam blocks inserted through suitable openings in walls 111–114, roof 110 or bottom 116. In any event, it is important for foam mass 102 to be put into shell 101 before concrete mass 108 is poured onto roof 110. The foam mass has sufficient compressive strength and completely fills shell 101 such that roof 110 does not deflect appreciably while the concrete aggregate-water mixture is being poured. Hence, the mold form remains stable during pouring so the set concrete has a predictable geometry.

As concrete mass 108 is setting, the top face of the concrete mass is troughed so it is flat and then brush finished to minimize slippage when someone walks on it. In addition, if desirable, the edges of the top of concrete mass 108 are finished smooth for aesthetic purposes.

The geometry of each of the buoyant wharf float modules 16 and 18 enables the individual modules and dock 10 to be stable, despite substantial wave action. In particular, the straight sides provided by walls 111–114 and lips 103–106 of the modules and the relative densities, volumes and positions of foam mass 102 and concrete mass 108 cause the modules to have a center of gravity 172 and a center of buoyancy 174 on vertical central axis 170. Axis 170 is equidistant from walls 111 and 112 and equidistant from walls 113 and 114. Center of gravity 172 is slightly higher than horizontal center line 176, which is equidistant from the bottom of floor 116 and the top face of the deck formed by concrete mass 108. Center of buoyancy 174 is approximately on horizontal center line 176. Because center of buoyancy 174 is somewhat lower than center of gravity 172 and is approximately on axis 170 and center line 176, the individual modules and the entire dock have great stability, causing the average water line 178 (FIG. 5) to be approximately on horizontal center line 174.

In the preferred embodiment, these results are achieved by (1) foam mass 102 having a density of approximately one pound per cubic foot, (2) concrete mass 108 having a density of approximately 200 pounds per cubic foot, (3) each module 16 and 18 having a height from the bottom face of floor 16 to the top face of the deck formed by concrete mass 108 of approximately 26 inches, (4) a length of approximately 60 inches between walls 113 and 114, (5) a width of approximately 36 inches between walls 112 and 113, (6) a height of concrete mass 108 of approximately two inches between the floor of each trough 124 and the roof 136 of each mesa 124, (7) a height of concrete mass 108 of approximately two inches between the roof 136 of each mesa 126 and the top face of the mass 108, (8) a span of approximately four inches of each trough 124 between walls 113 and 114, (9) a span of approximately eight inches of each central mesa 126 between walls 113 and 114, and (10) a width of approximately four inches of each end mesa 128 between walls 113 and 114.

Buoyant wharf module 16.13, carrying utility tower 39, is constructed similarly to the remaining modules in that float module 16.13 comprises (1) a tub having the same outer dimensions as the tubs of the remaining modules, (2) a closed water impervious shell including a foam mass, (3) a concrete mass forming a deck having five rods extending through the mass for connections to wales, (4) provisions for removing collected water, and (5) slots for receiving forks of a fork lift truck. Consequently, float module 16.13 has approximately the same buoyancy and stability properties as the remaining modules of dock 10 and has no substantial adverse effect on the overall buoyancy and stability of the dock.

However, module 16.13 differs from the remaining modules because module 16.13 includes provisions for enabling utility lines 180 to extend into tower 39. In the embodiment of FIG. 1, the utility lines extend from the gap where spacer tube 70 is located between modules 16.10–16.24 and 16.30–16.44 through module 16.13 into tower 39. The utility lines can extend from other locations, e.g., outboard of main pier portion 12, into tower 39.

Figure 17:
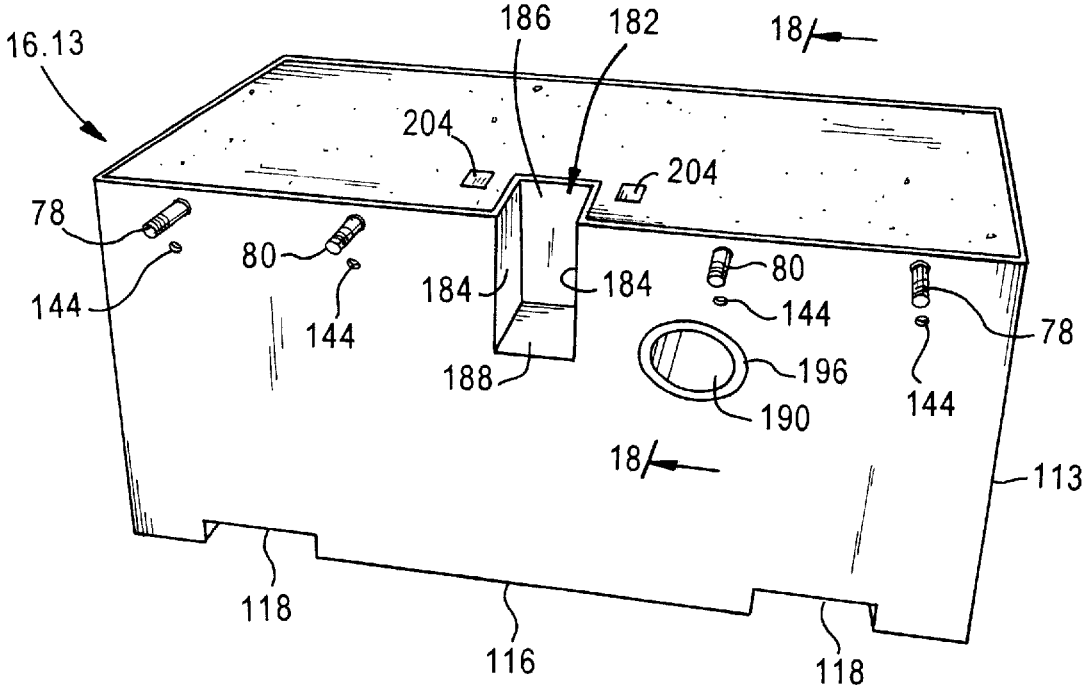
FIG. 17 is a perspective view of a buoyant wharf module for receiving a utility tower.
Figure 18:
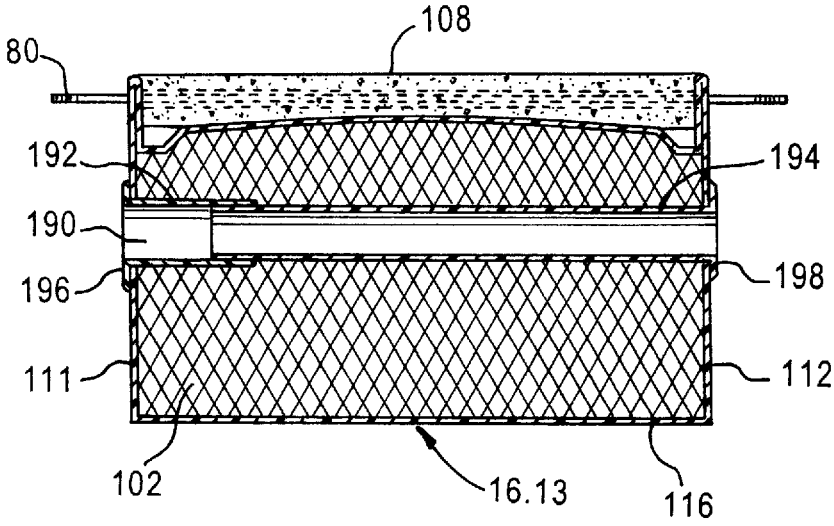
FIG. 18 is a side sectional view of the module of FIG. 17.
Figure 19:
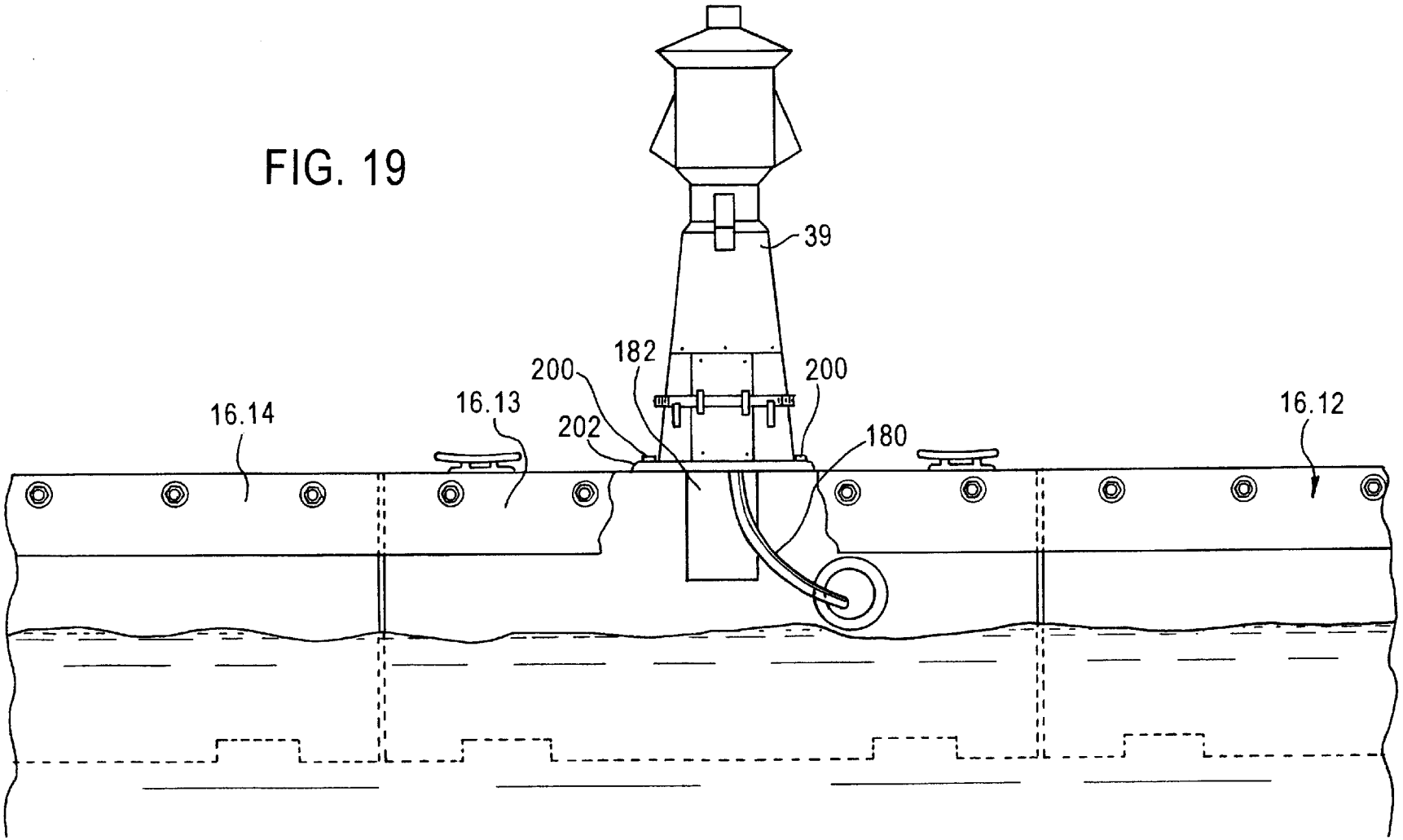
FIG. 19 is a side view of the portion of dock including the module illustrated in FIGS. 17 and 18.

To these ends, as illustrated in FIGS. 17–19, module 16.13 includes a transverse cylindrical tunnel, i.e., opening, 190 in foam mass 102 extending between the longitudinal walls 111 and 112 of tub 100. Tunnel 190 is approximately aligned with one of off center rods 80 and is slightly above horizontal center line 170. Tunnel 190 is lined by tubes 192 and 194, which are preferably formed by an organic compound, e.g., polyvinyl chloride, and are bonded to each other within the tunnel to form a water impervious liner.

Tubes 192 and 194 respectively include flanges 196 and 198 having interior walls bonded to the walls 113 and 114 of tub 100. Liner tubes 192 and 194 preferably have an inner diameter of about four inches to enable one or more utility lines 180 to easily extend through tunnel 190.

The other primary difference between module 16.13 and the remaining modules is that module 16.13 includes cut-out region 182 on its onboard side 113. Region 182 enables utility line 180 and possibly other utility lines to have access to utility tower 39 through the base of the tower. Region 182, shaped as a right parallelepiped, includes vertically extending parallel side walls 184, back wall 186, floor 188, a front opening across wall 113 and an open top. Region 182 is high, wide and deep enough to enable utility line 180 and possibly other utility lines to easily fit into it and extend vertically into tower 39 through the base of the tower.

Region 182 is preferably equidistant from side walls 113 and 114 to assist in enabling module 16.31 to ride evenly in water. In a preferred embodiment, region 180 has a height of about nine inches, so base 188 thereof is approximately aligned with the top of tunnel 190; the width and depth of region 180 are both preferably about four inches.

Mesh 150 in module 16.31 differs from the mesh of the remaining modules because the mesh of module 16.13 has a cut out portion to accommodate cut out region 182. The cut out portion of the mesh is along the outboard portion of module 16.13, adjacent longitudinal wall 113, about equidistance from side walls 111 and 112.

Four bolts 200 (only two of which are illustrated) fasten tower 39 to the deck of module 16.13, so the base of the tower surrounds the opening at the top of cutout region 182. Two of bolts 200 extend through circular openings in flange 202 at the base of tower 39 into threaded bores of sockets 204 encased in concrete mass 108, while the other two bolts are lap bolts that extend through circular openings on flange 202 into outboard wale 20. The base of tower 39 has an opening inside flange 202 through which utility line 180 extends.

While there has been described and illustrated a specific embodiment of the invention, it will be clear that variations in the details of the embodiment specifically illustrated and described may be made without departing from the true spirit and scope of the invention as defined in the appended claims. For example, short rods 78 and spacer tubes 70 associated therewith can alternate with long rods in tunnels 123 throughout the length of main pier portion 12. In such a situation, module 16.10 includes three short rods 78 and two long rods 80 while module 16.11 includes two short rods 78 and three long rods 80. One of the short rods of module 16.10 is next to one of the long rods of module 16.11 in this example.

We claim:

1. A buoyant wharf structure comprising a first upper portion fixedly and permanently secured to a second portion that is generally below the first portion, the second portion having a volume and density causing the structure to be buoyant, the first portion including (a) a deck and (b) a mold form fixedly and permanently secured to the second portion, the mold form having walls and a floor, the floor being fixedly and permanently secured to the walls, and a molded mass having a density greater than water substantially filling the mold form.

2. The buoyant wharf structure of claim 1 wherein the second portion includes a foam mass, the foam mass having sufficient compressive strength and being positioned relative to the mold form to support the mold form and enable the mold form to remain relatively stable as the molded mass is being poured while in a plastic state into the mold form.

3. The buoyant wharf structure of claim 1 wherein the mold form and the molded mass are arranged so water collected by at least one of the mold form and the molded mass drains out of the structure through a drain arrangement.

4. A buoyant wharf structure of claim 3 wherein the drain arrangement is in the walls of the mold form.

5. The buoyant wharf structure of claim 3 wherein the mold form includes plural spaced troughs occupied by the molded mass, the troughs being arranged and positioned so the incident water migrates to the troughs, thence to the drain arrangement.

6. The buoyant wharf structure of claim 5 wherein the drain arrangement of a particular trough includes depressions forming sumps for the water migrating to the particular trough, the depressions being adjacent the opposite walls.

7. The buoyant wharf structure of claim 5 wherein each of the troughs extends to opposite walls of the mold form so the collected water migrates to the opposite walls, the drain arrangement including openings in the opposite walls, the openings being aligned with the troughs and positioned so the water migrating in the troughs to the opposite walls escapes through the openings.

8. The buoyant wharf structure of claim 7 wherein the drain arrangement of a particular trough includes depressions forming sumps for the water migrating to the particular trough, the depressions being adjacent the opposite walls.

9. The buoyant wharf structure of claim 8 wherein the mold form includes mesas between adjacent pairs of the troughs, the mesas and troughs being arranged so water collected on the mesas migrates to the troughs.

10. The buoyant wharf structure of claim 9 wherein the mesas have roofs and walls extending between the roofs and troughs, the roofs sloping downwardly toward the walls so water incident on the roofs migrates to the walls.

11. The buoyant wharf structure of claim 10 wherein the troughs have floors that slope toward the sumps.

12. The buoyant wharf structure of claim 8 wherein the troughs have floors that slope toward the sumps.

13. The buoyant wharf structure of claim 7 wherein the troughs have floors that slope toward the opposite walls.

14. The buoyant wharf structure of claim 1 wherein the mold form and at least an upper part of the second portion are a one-piece structure.

15. The buoyant wharf structure of claim 14 wherein the one-piece structure is a molded organic compound.

16. The buoyant wharf structure of claim 1 wherein the mold form and a shell forming the exterior of the entire second portion are a one-piece structure made of a molded organic compound.

17. The buoyant wharf structure of claim 16 wherein the foam mass is steamed foam substantially filling the second portion, and the second portion includes a sealed opening through which the steamed foam mass was injected into the second portion, the second portion forming a closed shell enclosing the foam mass.

18. The buoyant wharf structure of claim 17 wherein the foam mass comprises a close d c ell structure.

19. The buoyant wharf structure of claim 1 wherein the molded mass includes a plurality of tunnels extending generally parallel to each other and to a first pair of the mold form walls that are generally parallel to each other, the tunnels extending between a second pair of the mold form walls that are generally parallel to each other, and further including rods extending through the tunnels, the rods extending beyond the second pair of the walls, fasteners fixedly mounting the rods with respect to the tunnels and the mold form walls, the rods and tunnels having sizes and geometries such that portions of the exterior walls of the rods are spaced from certain portions of the walls of the tunnels so the rods can be manually moved longitudinally of the tunnels when the fasteners do not fixedly mount the rods.

20. The buoyant wharf structure of claim 19 further including a liner in the tunnels, the liners being fixedly positioned in the tunnels to prevent contact between the rods and the portions of the molded mass forming wall surfaces of the tunnels.

21. The buoyant wharf structure of claim 20 wherein the mold form includes plural spaced troughs occupied by the molded mass, the tunnels generally being aligned with and above floors of the troughs.

22. The buoyant wharf structure of claim 19 wherein the mold form includes plural spaced troughs occupied by the molded mass, the tunnels being generally aligned with and above floors of the troughs.

23. The buoyant wharf structure of claim 1 further including reinforcing mesh surrounded by and providing structural strength to the molded mass.

24. The buoyant wharf structure of claim 23 wherein the reinforcing mesh includes downwardly depending portions supported by the mold form floor and causing the remainder of the reinforcing mesh to be generally spaced above the mold form floor.

25. The buoyant wharf structure of claim 1 wherein the second portion includes a generally flat bottom, the bottom including a pair of elongated substantially parallel indentations, the indentations being spaced from each other and shaped for receiving a pair of forks of an industrial forklift truck.

26. The buoyant wharf structure of claim 25 wherein the indentations extend completely between exenigenerally parallel walls of the second portions so a forklift truck can pick up the structure by approaching both of the walls of the second portion.

27. The buoyant wharf structure of claim 1 wherein the molded mass is concrete and has an upper surface forming the deck.

28. The buoyant wharf structure of claim 1 wherein the structure includes a transverse opening extending between opposite walls of the structure for receiving a utility line, the upper portion including an indentation in the deck for receiving the utility line so the utility line can be inserted through the indentation into a utility tower adapted to be mounted above the indentation.

29. A buoyant wharf structure of claim 28 further including a utility tower fixedly mounted on the deck above the indentation, and a utility line extending between the walls through the opening into the indentation and into the tower.

30. The buoyant wharf structure of claim 28 wherein the transverse opening is in the lower portion above a center of buoyancy of the structure.

31. The buoyant wharf structure of claim 28 wherein the indentation is in the upper and lower portions.

32. A buoyant wharf structure comprising a first upper portion fixedly and permanently secured to a second portion that is generally below the first portion, the second portion having a volume and density causing the structure to be buoyant, the first portion including (a) a deck, (b) exterior walls and (c) a floor, the floor being water impervious and below the deck, and a molded mass having a density greater than water substantially filling the first portion between the floor and walls, the floor, walls and molded mass being arranged to form a drain arrangement so at least some water incident on the molded mass drains out of the structure.

33. The buoyant wharf structure of claim 32 wherein the drain arrangement is arranged so the incident water drains through the first portion.

34. The buoyant wharf structure of claim 32 wherein the drain arrangement is arranged so the incident water drains through at least some of the walls.

35. The buoyant wharf structure of claim 32 wherein the floor includes plural spaced troughs occupied by the molded mass, the troughs being part of the drain arrangement and being arranged and positioned so at least some of the incident water flows to the troughs, each of the troughs extending to opposite walls of the first portion so the incident water migrates to the opposite walls, the opposite walls including openings aligned with the troughs and positioned so the water migrating in the troughs to the opposite walls escapes through the openings.

36. The buoyant wharf structure of claim 35 wherein each of the troughs includes a depression forming a sump for the water migrating in the troughs, the depressions being adjacent the opposite walls, below and substantially vertically aligned with the openings.

37. The buoyant wharf structure of claim 36 wherein the floor includes mesas between adjacent pairs of the troughs, the mesas and troughs being arranged so at least some of the water incident on the mesas migrates to the troughs.

38. The buoyant wharf structure of claim 37 wherein the mesas have roofs and walls extending between the roofs and floors of the troughs, the roofs sloping downwardly toward the walls so at least some of the water incident on the roofs migrates to the walls.

39. The buoyant wharf structure of claim 38 wherein the troughs have floors that slope toward the sumps.

40. The buoyant wharf structure of claim 36 wherein the troughs have floors that slope toward the sumps.

41. The buoyant wharf structure of claim 35 wherein the troughs have floors that slope toward the opposite walls.

42. The buoyant wharf structure of claim 32 wherein the floor includes plural spaced troughs occupied by the molded mass, the troughs being part of the drain arrangement and being arranged and positioned so at least some of the incident water flows to the troughs, the drain arrangement including depressions forming sumps for the water migrating to the troughs.

43. The buoyant wharf structure of claim 42 wherein the depressions are adjacent opposite walls of the first portion.

44. A buoyant wharf structure comprising a first upper portion fixedly and permanently secured to a second portion that is generally below the first portion, the second portion having a volume and density causing the structure to be buoyant, the first portion including (a) a deck, (b) exterior walls and (c) a floor, the exterior walls of the first portion and a shell forming the exterior of the entire second portion being a molded organic compound, a foam mass in the shell, the first portion including a deck surrounded by the exterior walls of the first portion.

45. The buoyant wharf structure of claim 44 wherein the shell of the second portion encloses and is filled substantially with a steamed foam mass, the shell of the second portion including a sealed opening through which the steamed foam mass was injected into the second portion.

46. The buoyant wharf structure of claim 45 wherein the steamed foam mass comprises a closed cell structure.

47. A buoyant wharf structure comprising a first upper portion fixedly and permanently secured to a second portion that is generally below the first portion, the second portion having a volume and density causing the structure to be buoyant, the first portion including (a) a deck, (b) exterior walls and (c) a floor, the second portion including a bottom surface arranged to support the structure when the structure is on a flat bearing surface, the bottom surface including a pair of elongated substantially parallel indentations, the indentations being spaced from each other and shaped for receiving a pair of forks of an industrial forklift truck.

48. The buoyant wharf structure of claim 47 wherein the indentations extend to oppositely disposed walls of the second portion so a forklift truck can pick up the structure by approaching both of the oppositely disposed walls of the second portion.

49. A buoyant wharf structure comprising a first upper portion fixedly and permanently secured to a second portion that is generally below the first portion, the second portion having a volume and density causing the structure to be buoyant, the first portion including a deck, the deck being fixedly and permanently secured to the second portion, the first portion having exterior walls and a floor, the exterior walls and floor being molded together and made of the same material, and a molded mass having a density greater than water substantially filling the volume in the first portion above the floor and between the exterior walls, the molded mass resting on the floor while the structure is in use as a wharf structure floating in water.

50. The buoyant wharf structure of claim 49 wherein the floor includes plural spaced troughs generally occupied by the molded mass.

51. The buoyant wharf structure of claim 50 wherein the floor includes mesas between floors of adjacent pairs of the troughs.

52. The buoyant wharf structure of claim 51 wherein the molded mass includes a plurality of tunnels extending generally parallel to each other and to a first pair of the exterior side walls that are generally parallel to each other, the tunnels extending between a second pair of the exterior walls that are generally parallel to each other.

53. The buoyant wharf structure of claim 52 further including rods extending through the tunnels, the rods extending beyond the second pair of the exterior walls, fasteners fixedly mounting the rods with respect to the tunnels and the exterior walls, the rods and tunnels having sizes and geometries such that portions of the exterior surface of the rods are spaced from certain portions of the walls of the tunnels so the rods can be manually moved longitudinally of the tunnels when the fasteners do not fixedly mount the rods.

54. The buoyant wharf structure of claim 53 further including a liner in the tunnels, the liners being positioned in the tunnels to prevent contact between the rods and the portions of the molded mass forming wall surfaces of the tunnels.

55. The buoyant wharf structure of claim 54 wherein the tunnels are generally aligned with and above the troughs.

56. The buoyant wharf structure of claim 50 wherein the molded mass includes a plurality of rods extending generally parallel to each other and to a first pair of the exterior side walls that are generally parallel to each other, the tunnels extending between a second pair of the exterior walls that are generally parallel to each other, floors of adjacent pairs of the troughs being spaced from each other by mesas, the rods being generally aligned with and above the floors of the troughs and above roofs of the mesas.

57. A method of making and using a stable buoyant wharf structure from a shell having a first upper portion fixedly and permanently secured to a second portion that is generally below the first portion, the first portion having exterior walls and a water impervious floor, the method comprising feeding a filler having a density less than water into the second portion, then pouring a settable plastic mass into the first portion so the settable plastic mass engages the walls and the floor and the floor rests on the filler without being substantially deformed, causing the settable plastic mass to set against the floor and walls, then, putting the structure in water to function as a wharf structure with the floor and walls in situ.

58. The method of claim 57 wherein the filler is steamed foam, the steamed foam being fed into the second portion through at least one opening leading into the second portion, then sealing the at least one opening so the second portion is water tight.

59. The method of claim 57 further including placing reinforcing mesh in the first portion so downwardly extending portions of the mesh contact the floor and the vast majority of the mesh is spaced from the floor, the mesh being so placed prior to the plastic mass being poured into the first portion, the plastic mass being poured into the first portion so the mesh is covered by the plastic mass.

60. The method of claim 57 further including inserting flexible tubes between an opposite pair of the exterior walls and inserting filler rods in the tubes, the tubes and filler rods being in place during pouring of the settable mass and being such that the tubes and filler rods do not deflect substantially during the pouring, removing the filler rods to form lined tunnels in the set plastic mass, inserting further rods having an outer diameter substantially less than the inner diameters of the lined tunnels in the lined tunnels, and fastening the rods in place in the tunnels.

61. The method of claim 60 further including placing a first buoyant structure having substantially the same dimensions as a second buoyant structure next to each other so the further rods of the first and second buoyant structures extend in generally the same direction beyond longitudinal aligned edges of the first and second modules, and connecting the first and second buoyant structures to each other by fastening the portions of the further rods that extend beyond the aligned edges to wales that extend along the aligned edges.

62. The method of claim 61 wherein the fastening is performed by inserting threaded ends of the rods through openings in the wales, and tightening nuts on the threaded ends so the nuts apply compressive forces to the first and second buoyant structures via the wales.

63. A floating dock comprising an assemblage of buoyant wharf structures, each of the wharf structures including:

(a) a first upper portion fixedly and permanently secured to a second portion that is generally below the first portion, the second portion including a foam mass having a volume and density causing the structure to be buoyant, the first portion including (a) a deck and (b) a mold form fixedly and permanently secured to the second portion, (b) the mold form having walls and a floor, the floor being fixedly and permanently secured to the walls, (c) a molded mass having a density greater than water substantially filling the mold form; and structural members attached to and joining the buoyant wharf structures.

64. The dock of claim 63 wherein first and second adjacent ones of the buoyant wharf structures respectively include substantially aligned first and second openings extending in the molded masses of the first and second structures between a pair of side walls that are opposite and generally parallel to each other, first and second rods respectively extending through the first and second aligned openings, at least one spacer in a gap between facing sides of the first and second buoyant wharf structures, the spacer having third and fourth aligned openings on opposite wall portions thereof, the first and second substantially aligned openings being respectively aligned with the aligned third and fourth openings, the first and second rods respectively extending through the third and fourth aligned openings, and a fastener arrangement holding the first rod in situ in the first and third openings and holding the second rod in situ in the second and fourth openings.

65. The dock of claim 63 wherein first and second adjacent ones of the buoyant wharf structures respectively include first and second openings extending in the molded masses of the first and second structures between a pair of side walls that are opposite and generally parallel to each other, first and second rods respectively extending through the first and second aligned openings, at least one spacer in a gap between facing sides of the first and second buoyant wharf structures, and a fastener arrangement holding the first rod in situ in the first opening and in a first side wall portion of the spacer, and holding the second rod in situ in the second opening and a second side wall portion of the spacer.

66. The dock of claim 65 wherein the first and second buoyant wharf structures respectively include third and fourth aligned openings extending in the molded masses of the first and second structures between the pair of said walls that are generally parallel to each other, a third rod extending through the third and fourth aligned openings and spanning the gap without passing through a spacer, and another fastener arrangement holding the third rod in situ, in the third and fourth openings.

67. The dock of claim 65 wherein the spacer includes a rigid section spanning the gap substantially below the first and second openings thereof, and above a water line of the wharf, the assemblage including a multiplicity of pairs of the buoyant wharf structures situated and connected in substantially the same manner as the first and second buoyant wharf structures, the multiplicity of pairs being substantially longitudinally aligned to form an elongated pier portion of the dock, and utility lines located in the spacer above the rigid section, the lines extending lengthwise of the longitudinally aligned buoyant wharf structures.

68. The dock of claim 65 wherein the spacer includes a rigid section spanning the gap substantially below the first and second openings thereof, and above a water line of the wharf, the assemblage including a multiplicity of pairs of the buoyant wharf structures situated and connected in substantially the same manner as the first and second buoyant wharf structures, the multiplicity of pairs being substantially longitudinally aligned to form an elongated pier portion of the dock, and utility lines located in the spacer above the rigid section, the lines extending lengthwise of the longitudinally aligned buoyant wharf structures; further including wales extending lengthwise of the longitudinally aligned buoyant wharf structures; and fasteners securing the wales to the rods of longitudinally aligned buoyant wharf structures so the longitudinally aligned buoyant wharf structures are connected together.

69. The dock of claim 65 wherein the fastener arrangement includes threads on each rod, a washer fitting over ends of each rod, and nuts engaging the threads and washers.

70. The dock of claim 64 wherein the spacer includes a rigid section spanning the gap, the rigid section being substantially below the third and fourth openings and above a water line of the buoyant wharf structure, the assemblage including a multiplicity of pairs of the buoyant wharf structures situated and connected in substantially the same manner as the first and second buoyant wharf structures, the multiplicity of pairs being substantially longitudinally aligned to form an elongated pier portion of the dock, and utility lines located in the spacer above the rigid section, the lines extending lengthwise of the longitudinally aligned buoyant wharf structures.

71. A floating dock comprising an assemblage of buoyant wharf structures, each of the buoyant wharf structures including an upper portion including a molded mass forming a deck and a lower portion, the upper and lower portions being arranged for causing the deck to be in a freeboard condition while the assemblage is in a body of water, molded masses of first and second adjacent pairs of the buoyant wharf structures respectively having first and second openings extending from a first wall of the structures to a second wall of the structures that is opposite to and generally parallel to the first wall, first and second rods respectively extending through the first and second tunnels, at least one spacer in a gap between facing sides of the first and second buoyant wharf structures, the spacer having opposite first and second wall portions, the first and second rods respectively extending through the first and second openings, and a fastener arrangement holding the first rod in situ in the tunnel of the first buoyant wharf structure and in the first wall portion and holding the second rod in situ in the tunnel of the second buoyant wharf structure and in the second wall portion of the spacer.

72. The floating dock of claim 71 wherein the fastener arrangement includes threads on each rod, a washer fitting over ends of each rod, and nuts engaging the threads and washers.

73. The dock of claim 71 wherein the first and second buoyant wharf structures respectively include third and fourth aligned openings extending in the molded masses of the first and second structures between the pair of said walls that are generally parallel to each other, a third rod extending through the third and fourth aligned openings and spanning the gap without passing through a spacer, and another fastener arrangement holding the third rod in situ, in the third and fourth openings.

74. The floating dock of claim 71 wherein the assemblage includes a multiplicity of pairs of the buoyant wharf structures situated and connected in substantially the same manner as the first and second buoyant wharf structures, the multiplicity of pairs being substantially longitudinally aligned to form an elongated pier portion of the dock, and utility lines located in the spacers and extending lengthwise of the longitudinally aligned buoyant wharf structures.

75. The floating dock of claim 71 wherein one of the buoyant wharf structures includes a transverse opening extending between opposite walls of said one buoyant wharf structure, at least one of the utility lines extending through the transverse opening, the upper portion of said one buoyant wharf structure including an indentation in the deck through which the at least one utility line extends, and a utility tower fixedly mounted on the deck above the indentation, the at least one utility line extending into the utility tower.

76. The dock of claim 71 wherein the spacer includes a rigid section spanning the gap, the rigid section being substantially below the third and fourth openings and above a water line of the buoyant wharf structure, the assemblage including a multiplicity of pairs of the buoyant wharf structures situated and connected in substantially the same manner as the first and second buoyant wharf structures, the multiplicity of pairs being substantially longitudinally aligned to form an elongated pier portion of the dock, and utility lines located in the spacer above the rigid section, the lines extending lengthwise of the longitudinally aligned buoyant wharf structures.

77. A buoyant wharf structure comprising a first upper deck portion fixedly and permanently secured to a second portion that is generally below the first portion, the second portion having a volume and density causing the structure to be buoyant, the structure including a transverse opening extending between opposite walls of the structure for receiving a utility line, and the upper portion including an indentation in the deck for receiving the utility line.

78. The buoyant wharf structure of claim 77, further including a utility tower fixedly mounted on the deck above the indentation, and a utility line extending between the walls through the opening into the indentation and into the tower.

* * * * *